US009023154B2

(12) United States Patent
Matsumoto et al.

(10) Patent No.: US 9,023,154 B2
(45) Date of Patent: May 5, 2015

(54) CLEANING METHOD, CLEANING APPARATUS, AND LIQUID EJECTING APPARATUS

(75) Inventors: Daisuke Matsumoto, Matsumoto (JP); Yoichi Yamada, Shiojiri (JP); Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 560 days.

(21) Appl. No.: 13/301,989

(22) Filed: Nov. 22, 2011

(65) Prior Publication Data

US 2012/0132231 A1 May 31, 2012

(30) Foreign Application Priority Data

Nov. 29, 2010 (JP) ..... 2010-265182
Nov. 29, 2010 (JP) ..... 2010-265183
Dec. 2, 2010 (JP) ..... 2010-269478

(51) Int. Cl.

| | |
|---|---|
| ***B08B 5/04*** | (2006.01) |
| ***B08B 7/04*** | (2006.01) |
| ***B41J 2/165*** | (2006.01) |
| ***B41J 2/175*** | (2006.01) |

(52) U.S. Cl.

CPC ..... *B41J 2/16532* (2013.01); *B41J 2/16526* (2013.01); *B41J 2/17596* (2013.01)

(58) Field of Classification Search

None

See application file for complete search history.

(56) References Cited

U.S. PATENT DOCUMENTS 8,167,401 B2 * 5/2012 Kyoso ..... 347/30

FOREIGN PATENT DOCUMENTS

| | | | | |
|---|---|---|---|---|
| JP | 2005225163 | * | 8/2005 | ..... B41J 2/18 |
| JP | 2006-312262 | | 11/2006 | |
| JP | 2007136829 | * | 6/2007 | ..... B41J 2/18 |
| JP | 2009226619 | * | 10/2009 | ..... B41J 2/175 |

OTHER PUBLICATIONS

English Translation: JP2009226619, JP2007136829 and JP2005225163.*

* cited by examiner

*Primary Examiner* — Eric Golightly
*Assistant Examiner* — Arlyn I Rivera-Cordero
(74) *Attorney, Agent, or Firm* — Workman Nydegger

(57) ABSTRACT

In the printer, after ink is discharged from nozzle openings by making a closed space area, formed by bringing a cap into contact with a recording head, enter into a negative pressure state due to negative pressure accumulated in a discharge flow path by driving a pump, when making the negative pressure state of the closed space area be subjected to a pressure change in a direction of coming to an atmospheric pressure state, after the air flows into the closed space area by making a second opening and closing valve provided at an inflow flow path which makes the closed space area and an aerial space communicate with each other be in an opened state, the inflow of the air into the closed space area through the inflow flow path is stopped in a state where negative pressure remains in the closed space area.

13 Claims, 13 Drawing Sheets

| | DIFFERENTIAL PRESSURE VALVE | FIRST OPENING AND CLOSING VALVE | SECOND OPENING AND CLOSING VALVE | FIRST PUMP | SECOND PUMP | PRESSURE STATE OF CLOSED SPACE AREA | TIME |
|---|---|---|---|---|---|---|---|
| BEFORE EXECUTION | CLOSE | CLOSE | CLOSE | STOP | STOP | P0 | – |
| PRESSURE ACCUMULATION PROCESS<br>FIRST PUMP: PRESSURE CHARGE<br>SECOND PUMP: PRESSURE CHARGE | CLOSE | CLOSE | CLOSE | DRIVE | DRIVE | P0 | t0 |
| DISCHARGE PROCESS | OPEN | OPEN | CLOSE | STOP | STOP | P0→P1→P2 | t1 |
| FIRST PRESSURE CHANGE PROCESS | OPEN | OPEN | OPEN | STOP | STOP | P2→P3 | t2 |
| SECOND PRESSURE CHANGE PROCESS | CLOSE | OPEN | OPEN | STOP | STOP | P3→P0 | |

FIG. 3A

| | DIFFERENTIAL PRESSURE VALVE | FIRST OPENING AND CLOSING VALVE | SECOND OPENING AND CLOSING VALVE | PUMP | VALVE OPENED TO THE AIR | PRESSURE STATE OF CLOSED SPACE AREA | TIME |
|---|---|---|---|---|---|---|---|
| BEFORE EXECUTION | CLOSE | CLOSE | CLOSE | STOP | CLOSE | P0 | – |
| PRESSURE ACCUMULATION PROCESS | CLOSE | CLOSE | CLOSE | DRIVE | CLOSE | P0 | t0 |
| DISCHARGE PROCESS | OPEN | OPEN | CLOSE | STOP | CLOSE | P0 → P1 → P2 | t1 |
| FIRST PRESSURE CHANGE PROCESS | OPEN | OPEN | OPEN | STOP | OPEN | P2 → P3 | t2 |
| SECOND PRESSURE CHANGE PROCESS | CLOSE | OPEN | OPEN | STOP | CLOSE | P3 → P0 | |

FIG. 6A

| | DIFFERENTIAL PRESSURE VALVE | FIRST OPENING AND CLOSING VALVE | SECOND OPENING AND CLOSING VALVE | FIRST PUMP | SECOND PUMP | PRESSURE STATE OF CLOSED SPACE AREA | TIME |
|---|---|---|---|---|---|---|---|
| BEFORE EXECUTION | CLOSE | CLOSE | CLOSE | STOP | STOP | P0 | – |
| PRESSURE ACCUMULATION PROCESS<br>FIRST PUMP: PRESSURE CHARGE<br>SECOND PUMP: PRESSURE CHARGE | CLOSE | CLOSE | CLOSE | DRIVE | DRIVE | P0 | t0 |
| DISCHARGE PROCESS | OPEN | OPEN | CLOSE | STOP | STOP | P0 → P1 → P2 | t1 |
| FIRST PRESSURE CHANGE PROCESS | OPEN | OPEN | OPEN | STOP | STOP | P2 → P3 | t2 |
| SECOND PRESSURE CHANGE PROCESS | CLOSE | OPEN | OPEN | STOP | STOP | P3 → P0 | |

FIG. 8A

| | DIFFERENTIAL PRESSURE VALVE | FIRST OPENING AND CLOSING VALVE | SECOND OPENING AND CLOSING VALVE | PUMP | PRESSURE STATE OF CLOSED SPACE AREA | TIME |
|---|---|---|---|---|---|---|
| BEFORE EXECUTION | CLOSE | CLOSE | CLOSE | STOP | P0 | – |
| PRESSURE ACCUMULATION PROCESS | CLOSE | CLOSE | CLOSE | DRIVE | P0 | t0 |
| DISCHARGE PROCESS | OPEN | OPEN | CLOSE | STOP | P0 → P1 → P2 | t1 |
| FIRST PRESSURE CHANGE PROCESS | OPEN | OPEN | OPEN | STOP | P2 → P3 | t2 |
| SECOND PRESSURE CHANGE PROCESS | CLOSE | OPEN | OPEN | STOP | P3 → P0 | |

FIG. 9A

| | DIFFERENTIAL PRESSURE VALVE | FIRST OPENING AND CLOSING VALVE | SECOND OPENING AND CLOSING VALVE | FIRST PUMP | SECOND PUMP | PRESSURE STATE OF CLOSED SPACE AREA | TIME |
|---|---|---|---|---|---|---|---|
| BEFORE EXECUTION | CLOSE | CLOSE | CLOSE | STOP | STOP | P0 | – |
| PRESSURIZATION PROCESS | CLOSE | CLOSE | OPEN | STOP | DRIVE | P0 → P5 | t4 |
| PRESSURE ACCUMULATION PROCESS<br>FIRST PUMP: PRESSURE CHARGE<br>SECOND PUMP: PRESSURE CHARGE | CLOSE | CLOSE | CLOSE | DRIVE | DRIVE | P5 | t0 |
| DISCHARGE PROCESS | OPEN | OPEN | CLOSE | STOP | STOP | P5 → P1 → P2 | t1 |
| FIRST PRESSURE CHANGE PROCESS | OPEN | OPEN | OPEN | STOP | STOP | P2 → P3 | t2 |
| SECOND PRESSURE CHANGE PROCESS | CLOSE | OPEN | OPEN | STOP | STOP | P3 → P0 | |

CLEANING METHOD, CLEANING APPARATUS, AND LIQUID EJECTING APPARATUS

CROSS REFERENCES TO RELATED APPLICATIONS

The entire disclosure of Japanese Patent Application Nos. 2010-265182, filed Nov. 29, 2010, 2010-265183, filed Nov. 29, 2010, and 2010-269478, filed Dec. 2, 2010 are expressly incorporated herein by reference.

BACKGROUND

1. Technical Field

The present invention relates to a cleaning method, a cleaning apparatus, and a liquid ejecting apparatus.

2. Related Art

Heretofore, as one type of a liquid ejecting apparatus which ejects liquid onto a recording medium, an ink jet type printer has been widely known. The printer performs recording on the recording medium by ejecting ink (liquid) from nozzle openings formed in a liquid ejecting head.

The printer performs so-called cleaning in which in a state where a closed space area is formed by bringing a bottomed box-shaped cap into contact with the liquid ejecting head so as to surround the nozzle openings which eject ink, suction is performed on the closed space area by a suction section, in order to reduce poor discharge of ink.

Incidentally, when removing the cap from the liquid ejecting head at the time of the end of ink suction in the cleaning, it is necessary to return the negative pressure state of the closed space area to an atmospheric pressure state. However, in naturally returning the negative pressure state of the closed space area to the atmospheric pressure state, since ink continues to be suctioned by the negative pressure of the closed space area for a relatively long time, there is concern that ink may be wastefully consumed in the cleaning. Therefore, a printer described in JP-A-2006-312262 has been proposed.

In the printer of JP-A-2006-312262, an air communication tube which allows the air to flow into a cap and an air communication valve capable of opening and closing the air communication tube are provided. Then, at the time of the end of ink suction in cleaning, the air communication valve is opened, thereby allowing the air to actively flow into a closed space area, whereby the negative pressure state of the closed space area is subjected to a rapid pressure change until it turns to an atmospheric pressure state.

However, if the negative pressure state of the closed space area is subjected to a rapid pressure change until it turns to the atmospheric pressure state, a pressing force is applied from the nozzle opening toward the inside of the liquid ejecting head by the air rapidly flowed into the closed space area. Therefore, the air in the closed space area is drawn into a normal nozzle or a nozzle with air bubbles removed, so that there is concern that breaking of a meniscus of ink in the nozzle may occur.

SUMMARY

An advantage of some aspects of the invention is that it provides a cleaning method in which it is possible to suppress breaking of a meniscus in a nozzle while suppressing the consumption of liquid in cleaning, a cleaning apparatus, and a liquid ejecting apparatus.

According to a first aspect of the invention, there is provided a cleaning method of performing cleaning in which suction is performed on a closed space area enclosed and formed between a liquid ejecting head and a bottomed box-shaped cap by bringing the cap into contact with the liquid ejecting head so as to surround nozzle openings which eject liquid in the liquid ejecting head, by a suction section, thereby discharging the liquid from the nozzle openings, the method including: accumulating negative pressure in a flow path which is on the opposite side to the closed space area in a first flow path which communicates with the closed space area and which suction power by the suction section reaches, with a first opening and closing valve provided midway on the first flow path so as to be able to open and close the first flow path, as a boundary, by making the first opening and closing valve be in a closed state and also driving the suction section; discharging the liquid from the nozzle openings by making the first opening and closing valve be in an opened state, thereby making the closed space area be in a negative pressure state, after the pressure accumulation; and performing a pressure change in which the negative pressure state of the closed space area is subjected to a pressure change in a direction of coming to an atmospheric pressure state, by allowing the air to flow into the closed space area by making a second opening and closing valve provided midway on a second flow path which makes the closed space area and an aerial space communicate with each other, so as to be able to open and close the second flow path, be in an opened state, and also the inflow of the air into the closed space area through the second flow path is stopped in a state where the negative pressure remains in the closed space area, after the discharging.

According to this configuration, in the pressure change process, first, by allowing the air to flow into the closed space area in a negative pressure state through the second flow path, the negative pressure state of the closed space area is subjected to a rapid pressure change in a direction of coming to the atmospheric pressure state. Then, the inflow of the air into the closed space area through the second flow path is stopped in a state where negative pressure remains in the closed space area in which pressure has been changed in a direction of coming to the atmospheric pressure state in this manner. Thereafter, the negative pressure state remaining in the closed space area returns to the atmospheric pressure state by a slow pressure change through the first flow path. Therefore, it is possible to suppress a rapid change from the negative pressure state of the closed space area to the atmospheric pressure state and it is possible to suppress draw-in of the air of the closed space area from the nozzle opening of the liquid ejecting head into the nozzle. Therefore, it is possible to suppress breaking of a meniscus of a normal nozzle, new nozzle omission, or the like while suppressing the consumption of liquid involved in cleaning.

In the cleaning method according to the above aspect of the invention, the pressure change process may include a first pressure change process of stopping the inflow of the air into the closed space area through the second flow path just before the negative pressure state of the closed space area turns to the atmospheric pressure state, and a second pressure change process of making a pressure change be performed on the negative pressure state of the closed space area in a direction of coming to the atmospheric pressure state, more slowly than that at the time of the first pressure change process.

According to this configuration, the rapid pressure change from the negative pressure state to the atmospheric pressure state in the first pressure change process is stopped in a state where negative pressure remains in the closed space area. Then, in the second pressure change process, the negative pressure state due to the negative pressure remaining in the closed space area is subjected to a pressure change in a direction of coming to the atmospheric pressure state, more slowly than that at the time of the first pressure change process. Therefore, it is possible to slowly come to the atmospheric pressure state, so that it is possible to effectively suppress breaking of a meniscus of a normal nozzle, new nozzle omission, or the like.

In the cleaning method according to the above aspect of the invention, the magnitude of the absolute value of the negative pressure remaining in the closed space area in the pressure change process may equal to the magnitude of the absolute value of draw-in pressure of the liquid through the intermediary of the nozzle opening which is present in the liquid ejecting head.

Usually, in liquid which is present in the nozzle of the liquid ejecting head, the draw-in pressure of liquid from the liquid supply source side to the liquid ejecting head side through the intermediary of the nozzle opening is present in a very weak negative pressure state, so as to be able to form a meniscus having a concave shape from the nozzle opening toward the inside of the nozzle. Therefore, in a case where the absolute value of the negative pressure of the closed space area has become smaller than the absolute value of the draw-in pressure of liquid through the intermediary of the nozzle opening which is present in the liquid ejecting head by a pressure change due to the inflow of the air into the closed space area through the second flow path, the air in the closed space area is drawn into the nozzle. In this respect, according to the above configuration, the negative pressure state of the closed space area is not subjected to a rapid pressure change until the absolute value of the negative pressure thereof becomes smaller than the absolute value of the draw-in pressure of liquid through the intermediary of the nozzle opening in the liquid ejecting head due to the inflow of the air into the closed space area. In other words, even if the negative pressure state of the closed space area is subjected to a pressure change in a direction of coming to the atmospheric pressure state due to the inflow of the air into the closed space area, a pressing force from the closed space area side toward the inside of the liquid ejecting head through the intermediary of the nozzle opening is not generated. Therefore, draw-in of the air from the nozzle opening of the liquid ejecting head into the nozzle is suppressed. Therefore, it is possible to further suppress breaking of a meniscus of a normal nozzle, new nozzle omission, or the like while suppressing the consumption of liquid involved in cleaning.

In the cleaning method according to the above aspect of the invention, when a time to suction the liquid from the nozzle openings in the discharge process is set to be t1 and a time required for performing a pressure change on a pressure state of the closed space area in the pressure change process until it turns from the negative pressure state to the atmospheric pressure state is set to be t2, the relationship of t1<t2 may be established.

When performing a pressure change from the negative pressure state of the closed space area to the atmospheric pressure state in the pressure change process, since a time required for performing a rapid pressure change on the negative pressure state of the closed space area by the inflow of the air until just before it turns to the atmospheric pressure state is short, most of the time t2 in the pressure change process becomes a time to stop the inflow of the air into the closed space area in a state where negative pressure remains. Then, according to this configuration, in the pressure change process, since it is possible to slowly change pressure until the negative pressure state of the closed space area naturally turns to the atmospheric pressure state over time without almost performing suction, with the use of most of the time t2, it is possible to arrange a meniscus in the nozzle. Therefore, it is possible to further suppress breaking of a meniscus of a normal nozzle.

In the cleaning method according to the above aspect of the invention, the pressure accumulation process, the discharge process, and the pressure change process may be repeatedly carried out in order plural times.

According to this configuration, since suction provided with a pressure difference in a negative pressure direction from around atmospheric pressure where a nozzle recovery effect is high is performed plural times, even in a case where air bubbles which does not make the return of the nozzle be anticipated in single suction are present in the nozzle, it is possible to effectively remove air bubbles in the nozzle with the small consumption of ink. Therefore, it is possible to further suppress the consumption of liquid involved in cleaning.

In the cleaning method according to the above aspect of the invention, when a time until the next pressure accumulation process is started after the starting of the pressure change process is set to be t3, the relationship of t2>t3 may be established.

According to this configuration, in a case where the pressure accumulation process, the discharge process, and the pressure change process are repeatedly performed plural times, before the pressure of the closed space area becomes the atmospheric pressure in the pressure change process, the next pressure accumulation process is started and a change of the pressure state of the closed space area is stopped. Therefore, it is possible to always maintain the closed space area in a negative pressure state. Therefore, it is possible to suppress breaking of a meniscus of a normal nozzle, new nozzle omission, or the like.

In the cleaning method according to the above aspect of the invention, the first pressure change process may make the second opening and closing valve be in an opened state, thereby pressurizing and supplying the air to the closed space area, and the second pressure change process may stop the pressurization and supply of the air to the closed space area through the second flow path after the first pressure change process.

According to this configuration, in the first pressure change process, by pressurizing and supplying the air to the closed space area through the second flow path, the negative pressure state of the closed space area is subjected to a pressure change in a direction of coming to the atmospheric pressure state. Then, in the subsequent second pressure change process, since the pressurization and supply of the air to the closed space area through the second flow path is stopped, the negative pressure state of the closed space area returns to the atmospheric pressure state by a slow pressure change through the first flow path. Therefore, it is possible to suppress a rapid change from the negative pressure state of the closed space area to the atmospheric pressure state and it is possible to suppress draw-in of the air in the closed space area from the nozzle opening of the liquid ejecting head into the nozzle. Therefore, it is possible to suppress breaking of a meniscus of a normal nozzle, new nozzle omission, or the like while suppressing the consumption of liquid involved in cleaning. Further, the flow of liquid which flows from the nozzle openings toward the inner bottom surface of the cap can be cut between the nozzle formation surface of the liquid ejecting head and the inner bottom surface of the cap by the air imparted to the closed space area. Therefore, it is possible to suppress attachment of liquid to the nozzle formation surface by cleaning.

The cleaning method according to the above aspect of the invention may further include a pressurization process of making the second opening and closing valve be in an opened state, thereby pressurizing and supplying the air to the closed space area, before the discharge process.

According to this configuration, since the closed space area is pressurized by the pressurization process, it is possible to increase the flow rate of liquid flowing in the nozzle, by generating a larger pressure difference than the case of making the closed space area in the atmospheric pressure state be in the negative pressure state. Therefore, it is possible to efficiently discharge air bubbles by suppressing a lowering of discharge efficiency of air bubbles, which occurs in the case of making excessively large negative pressure act from the atmospheric pressure state.

Further, according to a second aspect of the invention, there is provided a cleaning apparatus including: a bottomed box-shaped cap which forms to enclose a closed space area between the cap and a liquid ejecting head by coming into contact with the liquid ejecting head so as to surround nozzle openings which eject liquid in the liquid ejecting head; a first opening and closing valve provided midway on a first flow path which communicates with the closed space area, so as to be able to open and close the first flow path; a second opening and closing valve provided midway on a second flow path which makes the closed space area and an aerial space communicate with each other, so as to be able to open and close the second flow path; a pressure adjusting valve which is disposed at a position which is on the opposite side to the closed space area with the second opening and closing valve in the second flow path as a boundary; and a suction section which generates negative pressure in the closed space area by making suction power reach the closed space area through the first flow path in a state where the first opening and closing valve is opened and also the second opening and closing valve is closed, wherein after the closed space area enters into a negative pressure state due to negative pressure generated based on the driving of the suction section, in a case where the second opening and closing valve is made to be in an opened state, so that a pressure change is performed in a direction in which the negative pressure state of the closed space area turns to an atmospheric pressure state, the pressure adjusting valve is closed just before the closed space area enters into an atmospheric pressure state with the progress of the pressure change.

According to this configuration, by allowing the air to flow into the closed space area which has entered into a negative pressure state due to negative pressure generated based on the driving of the suction section, the negative pressure state of the closed space area is subjected to a rapid pressure change in a direction of coming to the atmospheric pressure state. However, the pressure adjusting valve is closed just before the negative pressure state of the closed space area turns to the atmospheric pressure state, whereby a rapid pressure change into the atmospheric pressure state is stopped in a state where negative pressure remains in the closed space area. Therefore, it is possible to suppress a rapid pressure change until the negative pressure state of the closed space area turns to the atmospheric pressure state, so that it is possible to suppress draw-in of the air in the closed space area from the nozzle opening of the liquid ejecting head into the nozzle. Therefore, it is possible to suppress breaking of a meniscus of a normal nozzle, new nozzle omission, or the like while suppressing the consumption of liquid involved in cleaning.

Further, according to a third aspect of the invention, there is provided a liquid ejecting apparatus including: a liquid ejecting head having nozzle openings which eject liquid onto a recording medium; and the cleaning apparatus having the above configuration.

According to this configuration, the same operation and effects as those in the case of the above cleaning apparatus can be obtained.

According to a fourth aspect of the invention, there is provided a cleaning apparatus including: a bottomed box-shaped cap which forms to enclose a closed space area between the cap and a liquid ejecting head by coming into contact with the liquid ejecting head so as to surround nozzle openings which eject liquid in the liquid ejecting head; a first opening and closing valve provided midway on a first flow path which communicates with the closed space area, so as to be able to open and close the first flow path; a second opening and closing valve provided midway on a second flow path which makes the closed space area and an aerial space communicate with each other, so as to be able to open and close the second flow path; a pressure adjusting section which is disposed at a position which is on the opposite side to the closed space area with the second opening and closing valve in the second flow path as a boundary; and a suction section which generates negative pressure in the closed space area by making suction power reach the closed space area through the first flow path in a state where the first opening and closing valve is opened and also the second opening and closing valve is closed, wherein after the closed space area enters into a negative pressure state due to negative pressure generated based on the driving of the suction section, in a case where the second opening and closing valve is made to be in an opened state, the pressure adjusting section pressurizes and supplies the air to the closed space area through the second flow path, thereby making the negative pressure state of the closed space area be subjected to a pressure change in a direction of coming to an atmospheric pressure state, and also stops the pressurization and supply of the air to the closed space area through the second flow path just before the closed space area enters into an atmospheric pressure state with the progress of the pressure change.

According to this configuration, by pressurizing and supplying the air to the closed space area which has entered into a negative pressure state due to negative pressure generated based on the driving of the suction section, the negative pressure state of the closed space area is subjected to a rapid pressure change in a direction of coming to the atmospheric pressure state. However, the pressure adjusting section stops the pressurization and supply of the air just before the closed space area enters into the atmospheric pressure state, whereby a rapid pressure change into the atmospheric pressure state is stopped in a state where negative pressure remains in the closed space area. Therefore, it is possible to suppress a rapid pressure change until the negative pressure state of the closed space area turns to the atmospheric pressure state, so that it is possible to suppress draw-in of the air in the closed space area from the nozzle opening of the liquid ejecting head into the nozzle. Therefore, it is possible to suppress breaking of a meniscus of a normal nozzle, new nozzle omission, or the like while suppressing the consumption of liquid involved in cleaning.

In the cleaning apparatus according to the above aspect of the invention, the pressure adjusting section may be a pump which compresses the air, thereby accumulating positive pressure in a flow path which is on the opposite side to the closed space area with the second opening and closing valve in the second flow path as a boundary, and imparts the positive pressure predetermined such that a pressure absolute value becomes smaller than the negative pressure imparted to the closed space area by the driving of the suction section, to the closed space area.

According to this configuration, it is possible to impart positive pressure with the magnitude of the pressure absolute value defined by the pump, at once to the closed space area formed in the cap. Then, it is possible to perform a prompt pressure change on the negative pressure state of the closed space area in a direction of coming to the atmospheric pressure state, by the driving of the pump, and also to easily stop such a pressure change just before the closed space area enters into the atmospheric pressure state. Further, the flow of liquid which flows from the nozzle openings toward the inner bottom surface of the cap can be cut between the nozzle formation surface of the liquid ejecting head and the inner bottom surface of the cap by the air compressed by the pump and also imparted at once to the closed space area. Therefore, it is possible to suppress attachment of liquid to the nozzle formation surface by cleaning.

In the cleaning apparatus according to the above aspect of the invention, the magnitude of the pressure absolute value of the negative pressure which remains in the closed space area in a case where the pressure adjusting section has stopped the pressurization and supply of the air to the closed space area through the second flow path may be equal to the magnitude of the absolute value of draw-in pressure of the liquid through the intermediary of the nozzle opening which is present in the liquid ejecting head.

Usually, in liquid which is present in the nozzle of the liquid ejecting head, the draw-in pressure of liquid from the liquid supply source side to the liquid ejecting head side through the intermediary of the nozzle opening is present in a very weak negative pressure state, so as to be able to form a meniscus having a concave shape from the nozzle opening toward the inside of the nozzle. Therefore, in a case where the absolute value of the negative pressure of the closed space area has become smaller than the absolute value of the draw-in pressure of liquid through the intermediary of the nozzle opening which is present in the liquid ejecting head by a pressure change due to the inflow of the air into the closed space area through the second flow path, the air in the closed space area is drawn into the nozzle. In this respect, according to the above configuration, the negative pressure state of the closed space area is not subjected to a rapid pressure change until the absolute value of the negative pressure thereof becomes smaller than the absolute value of the draw-in pressure of liquid through the intermediary of the nozzle opening in the liquid ejecting head due to the inflow of the air into the closed space area. In other words, even if the negative pressure state of the closed space area is subjected to a pressure change in a direction of coming to the atmospheric pressure state due to the inflow of the air into the closed space area, a pressing force from the closed space area side toward the inside of the liquid ejecting head through the intermediary of the nozzle opening is not generated. Therefore, it is possible to suppress draw-in of the air from the nozzle opening of the liquid ejecting head into the nozzle. Therefore, it is possible to effectively suppress breaking of a meniscus of a normal nozzle, new nozzle omission, or the like while suppressing the consumption of liquid involved in cleaning.

In the cleaning apparatus according to the above aspect of the invention, the suction section and the pressure adjusting section may be the same single tube pump, the first and second flow paths connected to the tube pump may be tubes which are pressed together by the same pressing member provided at the tube pump, and the diameter of the tube of the second flow path may be smaller than the diameter of the tube of the first flow path.

According to this configuration, by making the flow path cross-sectional areas of the first flow path and the second flow path different from each other, it is possible to impart negative pressure and positive pressure in which the magnitudes of the pressure absolute values are different from each other, to the closed space area by a single tube pump. Therefore, it is possible to simply configure a cleaning apparatus in which it is possible to suppress breaking of a normal meniscus, new nozzle omission, or the like while suppressing the consumption of liquid involved in cleaning, without increasing the number of components.

In the cleaning apparatus according to the above aspect of the invention, the suction section and the pressure adjusting section may be the same single tube pump, the first and second flow paths connected to the tube pump may be tubes which are respectively pressed by different pressing members provided at the tube pump, and a pressing force of the pressing member which presses the tube of the second flow path may be smaller than a pressing force of the pressing member which presses the diameter of the tube of the first flow path.

According to this configuration, by changing the efficiency of the tube pump with respect to the first flow path and the second flow path, it is possible to impart negative pressure and positive pressure in which the magnitudes of the pressure absolute values are different from each other, to the closed space area by a single tube pump. Therefore, it is possible to simply configure a cleaning apparatus in which it is possible to suppress breaking of a normal meniscus, new nozzle omission, or the like while suppressing the consumption of liquid involved in cleaning.

Further, according to a fifth aspect of the invention, there is provided a liquid ejecting apparatus including: a liquid ejecting head having a plurality of nozzle openings which eject liquid onto a medium; and the cleaning apparatus having the above configuration.

According to this configuration, the same operation and effects as those in the above cleaning apparatus can be obtained.

BRIEF DESCRIPTION OF THE DRAWINGS

The invention will be described with reference to the accompanying drawings, wherein like numbers reference like elements.

FIG. 3A is a table showing the cleaning contents of the first embodiment.

FIG. 6A is a table showing the cleaning contents of the second embodiment.

FIG. 8A is a table showing the cleaning contents of the third embodiment.

FIG. 9A is a table showing the cleaning contents of a fourth embodiment.

DESCRIPTION OF EXEMPLARY EMBODIMENTS

First Embodiment

Hereinafter, a first embodiment in which the invention is embodied in an ink jet type printer (hereinafter also referred to as a "printer") that is one type of a liquid ejecting apparatus will be described based on FIGS. 1 to 4. In addition, in the case of referring to a "front-and-back direction", an "up-and-down direction", and a "left-and-right direction" in the following explanation, unless expressly stated otherwise, they are set to refer to a "front-and-back direction", an "up-and-down direction", and a "left-and-right direction" which are indicated by arrows in each drawing. Also, a direction from the rear side toward the front side in the "front-and-back direction" in this case is equivalent to a transport direction (a sub-scanning direction) of a recording medium, the "up-and-down direction" is equivalent to a vertical direction, and the "left-and-right direction" is equivalent to a width direction (a main scanning direction) intersecting the transport direction of the recording medium.

Figure 1:
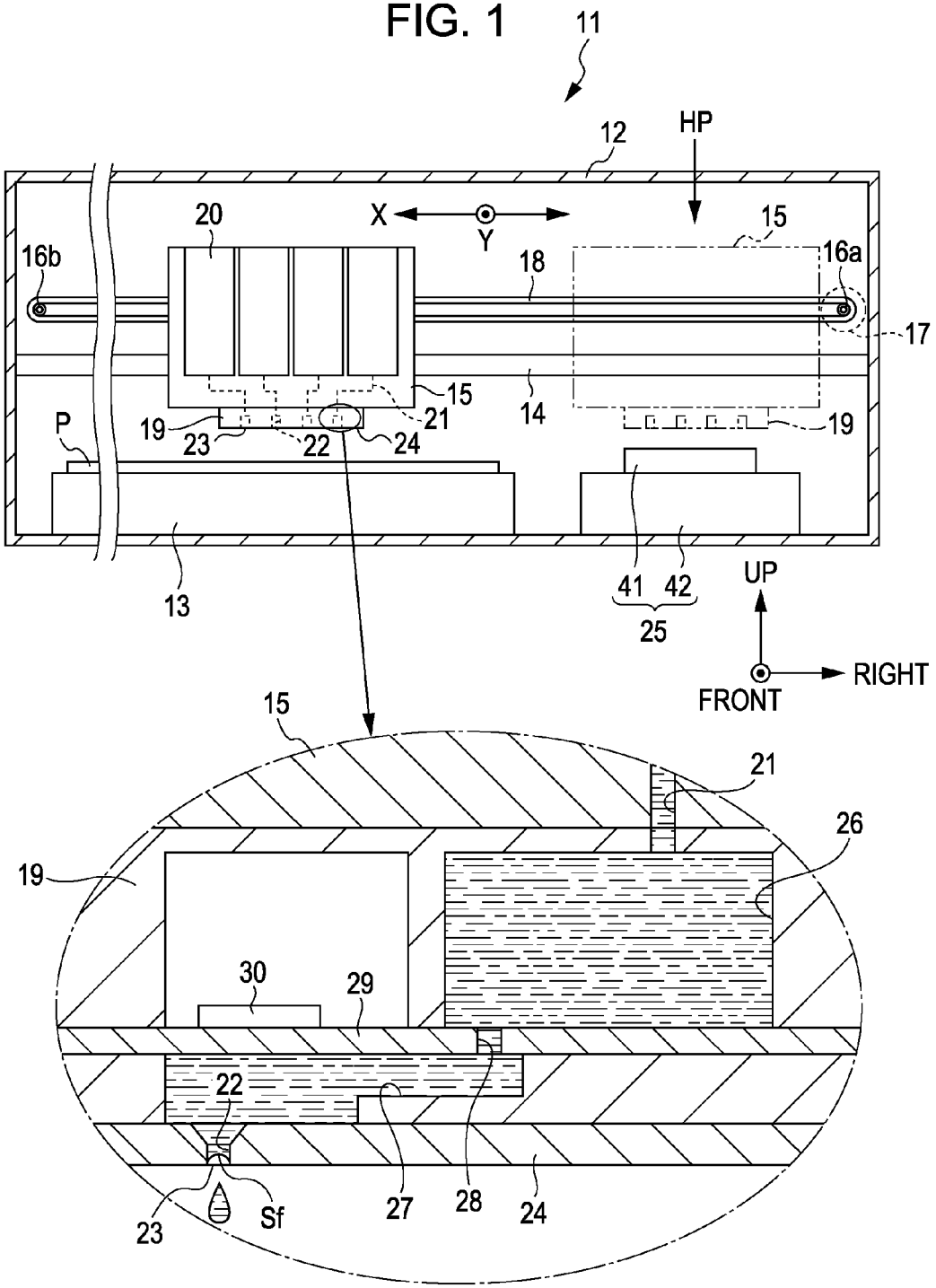
FIG. 1 is a cross-sectional view showing the schematic configuration of a printer in a first embodiment of the invention.

As shown in FIG. 1, at a lower portion of the inside of a box-shaped main body case 12 in a printer 11, a support member 13 for supporting recording paper P that is one example of the recording medium at the time of recording is provided to extend along a main scanning direction X (the "left-and-right direction" in FIG. 1). On the support member 13, the recording paper P is fed along a sub-scanning direction Y (a direction from the rear side toward the front side in FIG. 1) intersecting the main scanning direction X by a paper feed mechanism (not shown).

Further, a rod-shaped guide shaft 14 parallel to the longitudinal direction (the left-and-right direction) of the support member 13 is spanned and provided above the support member 13 in the main body case 12. On the guide shaft 14, a carriage 15 is supported in a state of being capable of reciprocating in the axial direction (the left-and-right direction and the main scanning direction X) of the guide shaft 14.

Further, at the respective positions corresponding to both end portions of the guide shaft 14 on the inner surface of a back wall of the main body case 12, a driving pulley 16*a* and a driven pulley 16*b* are respectively supported in a rotatable state. An output shaft of a carriage motor 17 which becomes a driving source when reciprocating the carriage 15 is connected to the driving pulley 16*a* and also an endless timing belt 18 with a portion connected to the carriage 15 is mounted to be wound around and extend between the pair of pulleys 16*a* and 16*b*. Therefore, the carriage 15 can be moved in the main scanning direction X (the left-and-right direction) through the endless timing belt 18 by the driving force of the carriage motor 17 while being guided by the guide shaft 14.

On the lower surface side of the carriage 15, a recording head 19 that is one example of a liquid ejecting head is provided. On the other hand, a plurality of (in this embodiment, four) ink cartridges 20 which accommodate ink that is one example of liquid are detachably mounted on the carriage 15. Then, ink accommodated in the ink cartridges 20 is supplied to the downstream side which is the recording head 19 side through an ink supply path 21.

Further, the lower surface of the recording head 19 becomes a horizontal nozzle formation surface 24 in which nozzle openings 23 of a plurality of nozzles 22 which eject ink are formed. In the nozzle formation surface 24, a plurality of nozzle rows, in which a plurality of nozzle openings 23 are continuously disposed in an equidistantly spaced-apart state along the sub-scanning direction Y (the front-and-back direction) that is the transport direction of the recording paper P, are disposed so as to be in parallel at regular intervals in the main scanning direction X (the left-and-right direction) of the recording head 19. Then, the recording head 19 carries out recording on the surface of the recording paper P by ejecting ink according to the passage of the recording paper P fed onto the support member 13 below the recording head 19.

Further, the right side of a recording area to which the recording paper P is transported in the main body case 12 becomes a home position HP which becomes a waiting place of the carriage 15 at the time of power-off of the printer 11 or when performing maintenance of the recording head 19. Further, at a position which becomes the lower side of the carriage 15 when the carriage 15 is disposed at the home position HP, a cleaning apparatus 25 for performing cleaning of the recording head 19 is provided.

Next, the recording head 19 will be described in detail.

Figure 2:
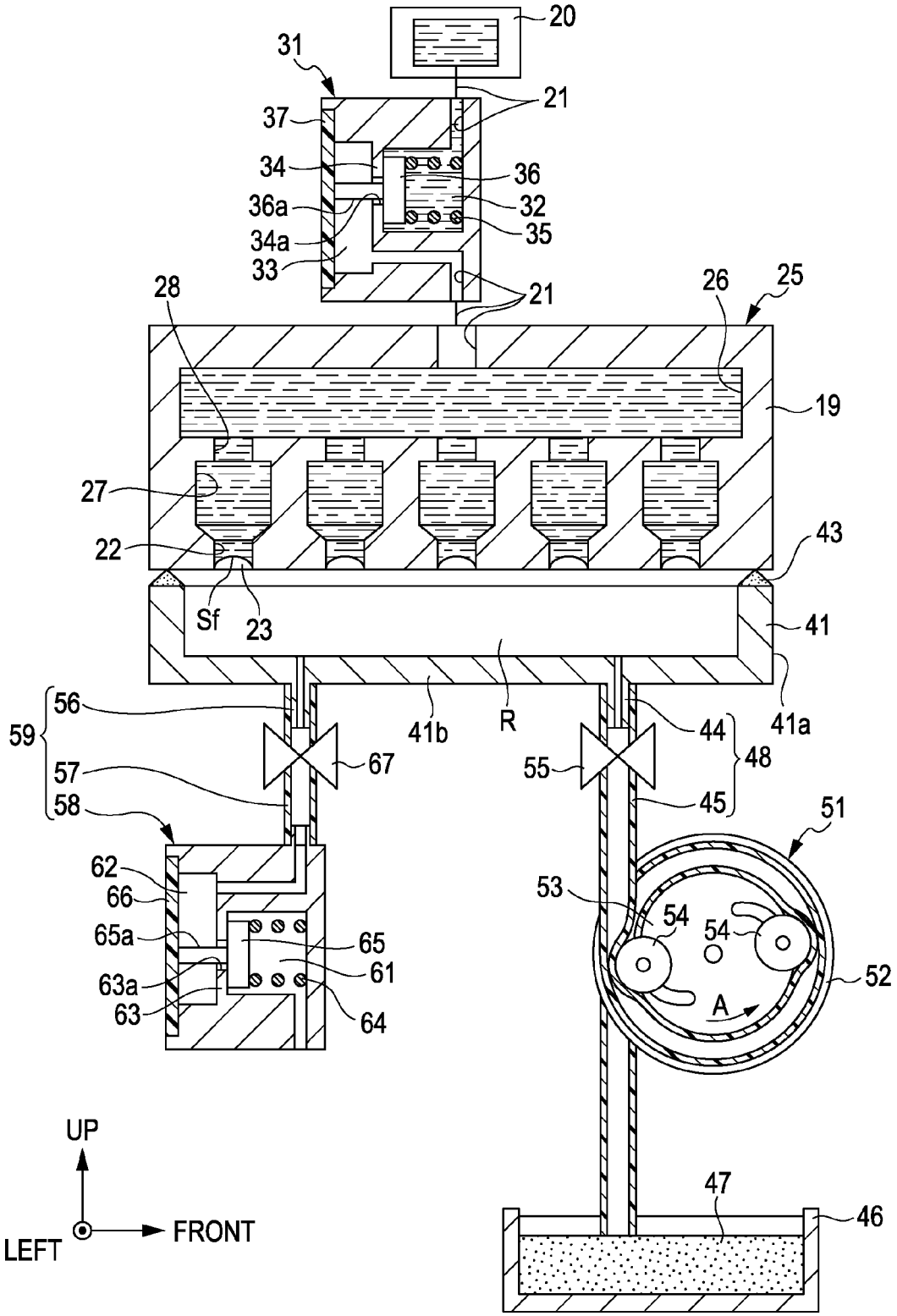
FIG. 2 is a cross-sectional view schematically showing the configurations of an ink supply path, a recording head, and a cleaning apparatus in the first embodiment.

As shown in a fragmentary enlarged view shown in an oval drawn-out enclosing frame in FIG. 1, and FIG. 2, in the recording head 19, a reservoir 26 is formed so as to extend in the front-and-back direction along the nozzle row. Further, in the recording head 19, cavities 27 which individually communicate with each nozzle 22 from a plurality of positions in the extending direction of the reservoir 26, and communication flow paths 28 each making the cavity 27 and the reservoir 26 communicate with each other are formed.

Further, as shown in the fragmentary enlarged view of FIG. 1, at a position adjacent to the cavity 27, a piezoelectric element 30 is disposed through the intermediary of a vibration plate 29 forming one wall surface of the cavity 27. That is, the piezoelectric element 30 contract and extends, thereby vibrating the vibration plate 29, whereby the volume of the cavity 27 is changed, thereby ejecting ink from the nozzle 22, and if ink in the cavity 27 is reduced with the ejection, ink is supplied from the ink cartridge 20 side through the communication flow path 28, the reservoir 26, and the ink supply path 21.

Further, as shown in the above-mentioned fragmentary enlarged view in FIG. 1, and FIG. 2, if the nozzle 22 is filled with ink from the upstream side which is the cavity 27 side, a meniscus Sf is formed in the nozzle 22 and in the vicinity of the nozzle opening 23 opened in the nozzle formation surface 24. In addition, the meniscus Sf is a curved surface in which the central portion of ink in the nozzle 22 can rise by a capillary action so as to form a concave surface shape toward the inside of the nozzle 22 when viewed from the nozzle opening 23. In this manner, usually, in ink which is present in the nozzle 22 of the recording head 19, draw-in pressure of ink from the ink cartridge 20 side to the recording head 19 side through the intermediary of the nozzle opening 23 is present in a very weak negative pressure state so as to be able to form the meniscus Sf.

Further, as shown in FIG. 2, at a position between the recording head 19 and the ink cartridge 20 in the ink supply path 21, a differential pressure valve 31 is provided which is one type of a valve which allows the passage of ink from the ink cartridge 20 side (the upstream side) to the recording head 19 side (the downstream side) in accordance with the decompression of the recording head 19 side, thereby allowing the pressure in the ink supply path 21 to be adjusted.

The differential pressure valve 31 has a storage chamber 32 which temporarily stores ink which is supplied from the ink cartridge 20 on the upstream side connected thereto through the ink supply path 21, and a pressure chamber 33 which is located further at the downstream side in the flow direction of ink than the storage chamber 32, thereby supplying ink to the recording head 19 side. The storage chamber 32 and the pressure chamber 33 communicate with each other by a through-hole 34*a* formed to penetrate a partition wall portion 34 separating both chambers. A shaft portion 36*a* of a valve body 36 is inserted into the through-hole 34*a*. The valve body 36 is biased by a spring 35 disposed in the storage chamber 32 to come into contact with the partition wall portion 34, thereby blocking the through-hole 34*a* to cut off the supply of ink to the recording head 19 side. Then, the valve body 36 moves in a valve-opening direction in which it is separated from the partition wall portion 34 against the biasing force of the spring 35, whereby the through-hole 34*a* is opened, so that a state where the storage chamber 32 and the pressure chamber 33 communicate with each other is created, thereby allowing the supply of ink to the recording head 19 side.

In addition, a portion (in FIG. 2, a rear side wall) of a wall surface of the pressure chamber 33 is constituted by a film 37 made of a flexible material (for example, synthetic resin, rubber, or the like). Then, for example, a cantilevered metal piece (for example, a piece of toothcomb-like metal pieces) (not shown) capable of being displaced along with the film 37 is attached to a place with which the shaft portion 36*a* of the valve body 36 comes into contact, of the surface on the pressure chamber 33 side of the film 37. In the differential pressure valve 31 configured in this manner, the inside of the pressure chamber 33 enters into a negative pressure state in accordance with a reduction in the amount of ink in the pressure chamber 33 due to ejection or the like of ink from the nozzle 22 of the recording head 19. Then, by differential pressure between the negative pressure in the pressure chamber 33 and atmospheric pressure, the film 37 is deflected in a direction (in FIG. 2, the front direction) of reducing the inner volume of the pressure chamber 33.

Then, if the deflection force of the film 37 in this case becomes larger than the biasing force of the spring 35, the valve body 36 is moved in the front direction that is a valve-opening direction by displacement of the film 37. The valve body 36 is opened, whereby ink in the storage chamber 32 flows into the pressure chamber 33. If ink flows into the pressure chamber 33, the negative pressure state in the pressure chamber 33 is reduced. If the negative pressure in the pressure chamber 33 is reduced, the force of deflecting the film 37 becomes weak, so that the valve body 36 is moved in a valve-closing direction by the biasing force of the spring 35. In this manner, in the differential pressure valve 31, the valve body 36 repeats displacement operations to the valve-opening direction and the valve-closing direction, whereby ink is supplied from the storage chamber 32 to the pressure chamber 33. Further, by the movement of the differential pressure valve 31, pressure is adjusted such that negative pressure is always present from the pressure chamber 33 up to the nozzle 22.

Next, the cleaning apparatus 25 will be described in detail.

As shown in FIGS. 1 and 2, the cleaning apparatus 25 includes a cap 41 formed into the form of a bottomed box with an upper side opened, and a lifting and lowering mechanism 42 (shown only in FIG. 1) for lifting and lowering the cap 41 in the up-and-down direction. A rectangular frame-shaped seal member 43 made of a flexible material (for example, synthetic resin, rubber, or the like) is disposed on the entire top surface of a peripheral wall 41*a* of the cap 41. The cap 41 is made to be capable of being displaced in a direction in which the cap 41 comes into contact with and is separated from the nozzle formation surface 24 of the recording head 19, by the lifting and lowering of the cap 41 in the up-and-down direction based on the driving of the lifting and lowering mechanism 42. Then, the cap 41 comes into contact with the nozzle formation surface 24 of the recording head 19, thereby surrounding the nozzle openings 23 of the nozzle formation surface 24 and also forming to enclose a closed space area R between the recording head 19 and the cap 41.

Further, as shown in FIG. 2, at a position nearer to the front side than the center in a bottom wall 41*b* of the cap 41, a discharge pipe 44 for discharging ink from the inside of the cap 41 is provided to protrude downward. To the discharge pipe 44, the base end side of a discharge tube 45 having flexibility is connected. On the other hand, the other end side of the discharge tube 45 is inserted into a waste ink tank 46 of a rectangular parallelepiped shape for recovering discharged ink at a lower portion of the inside of the main body case 12. In the waste ink tank 46, an ink absorber 47 which is made of a porous material that absorbs and retains waste ink is accommodated. Then, in this embodiment, a discharge flow path 48 that is one example of a first flow path which communicates with the closed space area R is constituted by the discharge pipe 44 and the discharge tube 45.

At a position between the cap 41 and the waste ink tank 46 in the discharge tube 45 constituting a portion of the discharge flow path 48, a pump 51 is disposed. The pump 51 is a tube pump having an approximately cylindrical pump case 52, and in the pump case 52, an intermediate portion in the longitudinal direction of the discharge tube 45 is accommodated so as to follow an inner peripheral wall of the pump case 52. Further, in the pump case 52, a rotatable rotating body 53 provided at the shaft center of the pump case 52, and a pair of pressing rollers 54 capable of pressing the discharge tube 45 while moving along the inner peripheral surface of the pump case 52 at the time of rotation of the rotating body 53 are accommodated.

Then, in the pump 51, in a case where the rotating body 53 is rotated in the counterclockwise direction indicated by a solid line arrow A in FIG. 2, the pressing rollers 54 are made to rotate while sequentially crushing the intermediate portion of the discharge tube 45 from the cap 41 side (the upstream side) to the waste ink tank 46 side (the downstream side). Then, air in the discharge tube 45 is expelled to the waste ink tank 46 side (the downstream side) by the rotation, so that the inside of the discharge tube 45 further on the cap 41 side (the upstream side) than the pump 51 is decompressed.

Further, at a position between the cap 41 and the pump 51 in the discharge tube 45, a first opening and closing valve 55 capable of opening and closing the discharge flow path 48 is provided. In addition, the first opening and closing valve 55 is a valve in which an opening and closing operation can be arbitrarily performed, and in this embodiment, it is constituted by an electromagnetic control valve.

Further, as shown in FIG. 2, at a position nearer to the back side than the center in the bottom wall 41*b* of the cap 41, an inflow pipe 56 for allowing the atmosphere (air) to flow into the cap 41 is provided to protrude downward. To the inflow pipe 56, the base end side of an inflow tube 57 having flexibility is connected. On the other hand, the leading end side of the inflow tube 57 is connected to a valve opened to the air 58 that is one example of a pressure adjusting valve which allows the passage of air from the air side (the upstream side) toward the cap 41 side (the downstream side) in accordance with the negative pressure state of the cap 41 side (the downstream side), thereby adjusting the pressure of the cap 41 side (the downstream side). Then, in this embodiment, an inflow flow path 59 that is one example of a second flow path which communicates with the closed space area is constituted by the inflow pipe 56, the inflow tube 57, and the valve opened to the air 58.

The valve opened to the air 58 has a configuration in which the above-described differential pressure valve 31 is upside down. The valve opened to the air 58 has a communication chamber 61 which communicates with an aerial space, and a pressure chamber 62 which is located further at the downstream side (the cap 41 side) in a flow direction of the air from the aerial space than the communication chamber 61. The communication chamber 61 and the pressure chamber 62 communicate with each other by a through-hole 63*a* formed to penetrate a partition wall portion 63 separating both chambers. A shaft portion 65*a* of a valve body 65 is inserted into the through-hole 63*a*. The valve body 65 is biased by a spring 64 disposed in the communication chamber 61 to come into contact with the partition wall portion 63, thereby blocking the through-hole 63*a*. Then, the valve body 65 moves in a valve-opening direction in which it is separated from the partition wall portion 63 against the biasing force of the spring 64, whereby the through-hole 63*a* is opened, so that a state where the communication chamber 61 and the pressure chamber 62 communicate with each other is created, thereby allowing the supply of the atmosphere (air) to the cap 41 side.

A portion (in FIG. 2, a rear side wall) of a wall surface of the pressure chamber 62 in the valve opened to the air 58 is constituted by a film 66 made of a flexible material (for example, synthetic resin, rubber, or the like). Then, for example, a cantilevered metal piece (for example, a piece of toothcomb-like metal pieces) (not shown) capable of being displaced along with the film 66 is attached to a place with which the shaft portion 65*a* of the valve body 65 comes into contact, of the surface on the pressure chamber 62 side of the film 66. In the valve opened to the air 58 configured in this manner, if the inside of the pressure chamber 62 enters into a negative pressure state in accordance with supply of the air in the pressure chamber 62 to the cap 41 side forming the closed space area R due to the cap 41 side (the downstream side) of the inflow flow path 59 entering into a negative pressure state, the film 66 is deflected and displaced in a direction (in FIG. 2, the front direction) of reducing the inner volume of the pressure chamber 62, by differential pressure between the pressure (negative pressure) in the pressure chamber 62 and atmospheric pressure.

Then, if the deflection force of the film 66 in this case becomes larger than the biasing force of the spring 64, the valve body 65 moves in a valve-opening direction, thereby allowing the air in the communication chamber 61 to flow into the pressure chamber 62, and on the other hand, if the negative pressure state of the pressure chamber 62 is removed by the inflow of the air into the pressure chamber 62, the valve body 65 is moved in a valve-closing direction again by the biasing force of the spring 64. In this manner, the valve body 65 repeats displacement operations to the valve-opening direction and the valve-closing direction, whereby the valve opened to the air 58 adjusts the pressure in the inflow flow path 59 further on the downstream side than the valve opened to the air 58. Further, in the valve opened to the air 58, in a case where the negative pressure state on the cap 41 side forming the closed space area R is subjected to a pressure change in accordance with the inflow of the air from the pressure chamber 62 side, when the absolute value of the negative pressure becomes smaller than the absolute value of the draw-in pressure of ink through the intermediary of the nozzle opening 23 for forming the meniscus Sf in the nozzle 22 of the recording head 19, the valve body 65 in an opened state enters into a closed state. That is, the biasing force of the spring 64 is adjusted so as to be able to move the valve body 65 in the valve-closing direction and the valve-opening direction in this manner.

Further, at a position between the cap 41 and the valve opened to the air 58 in the inflow tube 57, a second opening and closing valve 67 capable of opening and closing the inflow flow path 59 is provided. In addition, the second opening and closing valve 67 is also a valve in which an opening and closing operation can be arbitrarily performed, similarly to the first opening and closing valve 55, and in this embodiment, it is constituted by an electromagnetic control valve.

Next, the action of the printer 11 configured as described above will be described particularly focusing on a pressure change of the closed space area R when the cleaning apparatus 25 performs cleaning.

Incidentally, in the printer 11, air bubbles are mixed in the nozzle 22 at the time of replacement of the ink cartridge 20 or air bubbles are mixed in the nozzle 22 from the nozzle opening 23, whereby dot omission or the like occurs. In order to suppress deterioration in recording quality caused by such dot omission, in the printer 11, cleaning is carried out using the cleaning apparatus 25. In addition, as shown in FIG. 3A, before the cleaning is carried out, the differential pressure valve 31, the first opening and closing valve 55, the second opening and closing valve 67, and the valve opened to the air 58 are in closed states and also the driving of the pump 51 remains stopped.

First, if the cleaning is started, the printer 11 moves the carriage 15 up to the home position HP in an area above the cleaning apparatus 25 and stops it at a position immediately above the cap 41. Next, the lifting and lowering mechanism 42 raises the cap 41, thereby bringing the leading end of the seal member 43 of the cap 41 into contact with the nozzle formation surface 24. Then, the closed space area R is formed between the nozzle formation surface 24 and the cap 41. In addition, as shown in FIGS. 3A and 3B, the pressure state of the closed space area R at this time is under atmospheric pressure P0.

Figure 3B:
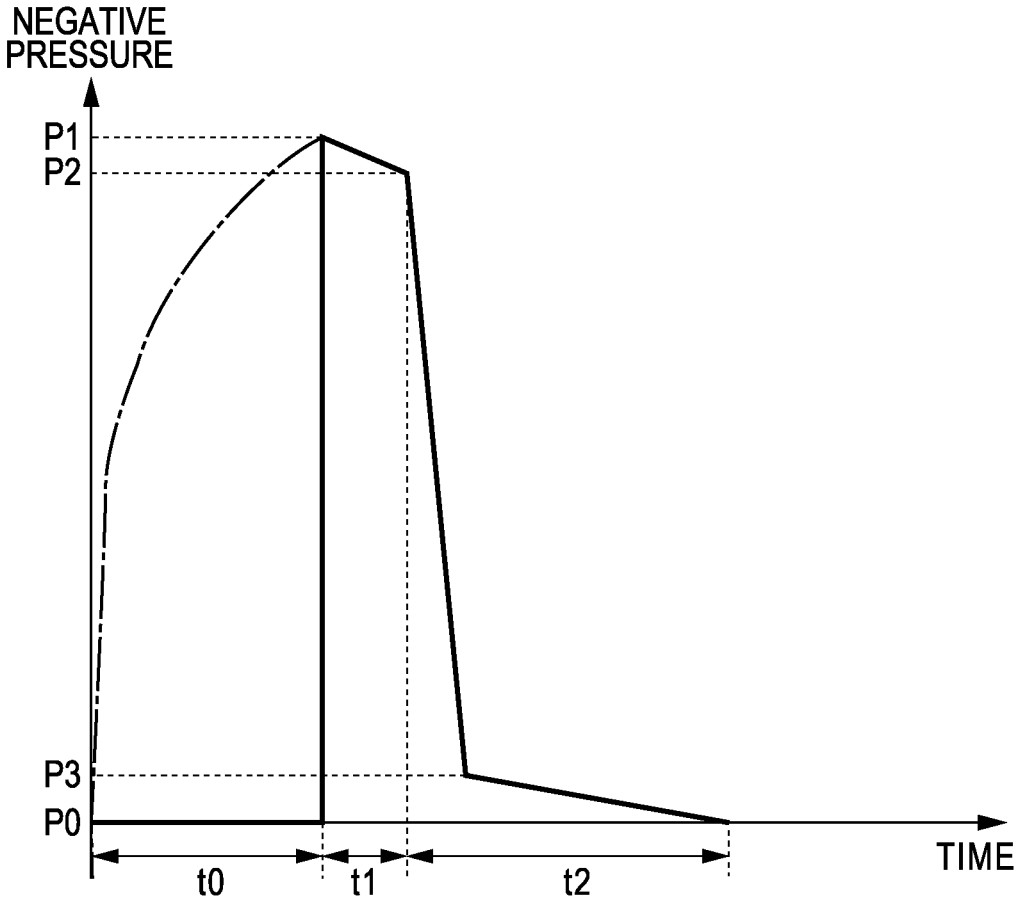
FIG. 3B is a graph showing a change in the pressure state of a closed space area at the time of cleaning in the first embodiment.

Next, as shown in FIG. 3A, as a pressure accumulation process, the pump 51 is driven in a state where the first opening and closing valve 55 and the second opening and closing valve 67 are closed. Then, the inside of the discharge tube 45 further on the upstream side (the cap 41 side) than the pump 51 is decompressed, so that negative pressure is accumulated in an area between the pump 51 and the first opening and closing valve 55, which is on the opposite side to the closed space area R with the first opening and closing valve 55 in the discharge flow path 48 as a boundary. In addition, a changing state of the negative pressure which is accumulated in the discharge flow path 48 at this time is shown by a dashed-dotted line in FIG. 3B.

After a pressure accumulation time t0 has elapsed from the starting of the pressure accumulation process, as a discharge process, the printer 11 stops the driving of the pump 51 and also makes the first opening and closing valve 55 be in an opened state. Then, the closed space area R and the discharge flow path 48 communicate with each other and also the closed space area R is decompressed at once by the negative pressure accumulated in the discharge flow path 48 in the area between the first opening and closing valve 55 and the pump 51, so that the pressure state of the closed space area R turns from the atmospheric pressure P0 to negative pressure P1, as shown by a solid line in FIG. 3B. Then, the differential pressure valve 31 enters into an opened state due to the negative pressure state of the closed space area R, so that ink is supplied from the ink cartridge 20 side to the recording head 19 side and also air bubbles, thickened ink, or the like is discharged along with ink from the nozzle openings 23 of the recording head 19 into the cap 41. Further, as shown in FIG. 3B, by the discharge of ink from the nozzle openings 23 into the closed space area R, the pressure state of the closed space area R slightly changes from the negative pressure P1 to negative pressure P2 in a direction to the atmospheric pressure P0.

After a discharge time t1 which discharges ink from the nozzle openings 23 of the recording head 19 has elapsed from the starting of the discharge process and also the pressure state of the closed space area R has changed from the negative pressure P1 to the negative pressure P2, the printer 11 makes the second opening and closing valve 67 be in an opened state, as a first pressure change process in a pressure change process. Then, the closed space area R and the inflow flow path 59 communicate with each other and also the valve opened to the air 58 enters into an opened state through the inflow flow path 59 due to the negative pressure state of the closed space area R. Then, the closed space area R and an aerial space communicate with each other, so that the air flows at once into the closed space area R through the inflow flow path 59, whereby the pressure state of the closed space area R rapidly changes from the negative pressure P2 in a direction of coming to the atmospheric pressure P0.

Here, in ink which is present in the nozzle 22 of the recording head 19, the draw-in pressure from the ink cartridge 20 side to the recording head 19 through the intermediary of the nozzle opening 23 is present so as to be capable of forming a meniscus having a concave shape from the nozzle opening 23 toward the inside of the nozzle 22. Therefore, in a case where the absolute value of the negative pressure of the closed space area R has become smaller than the absolute value of the draw-in pressure of ink to the recording head 19 through the intermediary of the nozzle opening 23 due to the inflow of the air into the closed space area R through the inflow flow path 59, the air in the closed space area R is drawn into the nozzle 22. However, the valve opened to the air 58 which is in an opened state is made to be closed when the absolute value of the negative pressure of the closed space area R has become equal to the absolute value of the draw-in pressure of ink to the recording head 19 through the intermediary of the nozzle opening 23, that is, before the absolute value of the negative pressure of the closed space area R becomes smaller than the absolute value of the draw-in pressure. Therefore, in the first pressure change process, the valve opened to the air 58 stops the inflow of the air into the closed space area R in a state where negative pressure P3 having a pressure absolute value of the same magnitude as that of the draw-in pressure of ink in the recording head 19 remains in the closed space area R. As a result, as shown in FIG. 3B, a pressure change of the closed space area R in the first pressure change process is stopped after rapid change from the negative pressure P2 to the negative pressure P3 and just before it turns to the atmospheric pressure P0. At this time, the valve opened to the air 58 enters into a closed state and at the same time, the differential pressure valve 31 also enters into a closed state. Therefore, discharge of ink from the nozzle openings 23 of the recording head 19 is stopped. In addition, with regard to the magnitude of the negative pressure P3 remaining in the closed space area R when closing the valve opened to the air 58, a time when it has become equal to the absolute value of the draw-in pressure of ink to the recording head 19 through the intermediary of the nozzle opening is set to means a time when it has become a pressure value in a pressure range of 1/10 of the above negative pressure P2 to ½ of the above draw-in pressure.

After the rapid pressure change of the closed space area R is stopped in the first pressure change process, as a second pressure change process of the pressure change process, the printer 11 changes the negative pressure P3 which remains in the closed space area R, in a direction of coming to the atmospheric pressure P0, in a state where the inflow of the air into the closed space area R has been stopped. As a result, as shown in FIG. 3B, the remaining some negative pressure P3 of the closed space area R naturally slowly changes into the atmospheric pressure P0 through the discharge flow path 48. At this time, since in the nozzle 22 of the recording head 19, ink is slightly suctioned, the meniscus Sf of ink in the vicinity of the nozzle opening 23 is arranged. Further, when changing pressure until the pressure state of the closed space area R turns from the negative pressure P2 to the atmospheric pressure P0 in the pressure change process, the time required for the first pressure change process is short. Therefore, the greater part of the pressure change time t2 in which the pressure state of the closed space area R changes from the negative pressure P2 up to the atmospheric pressure P0 becomes the time required for the second pressure change process. Then, the pressure change time t2 becomes longer than the discharge time t1 (t1<t2).

After the pressure change time t2 has elapsed from the starting of the pressure change process, the lifting and lowering mechanism 42 lowers the cap 41 up to the original position and also the inside of the cap 41 is subjected to idle suction by the driving of the pump 51, whereby ink remaining in the cap 41 is discharged into the waste ink tank 46. Then, the cleaning by the cleaning apparatus 25 is ended.

Figure 4:
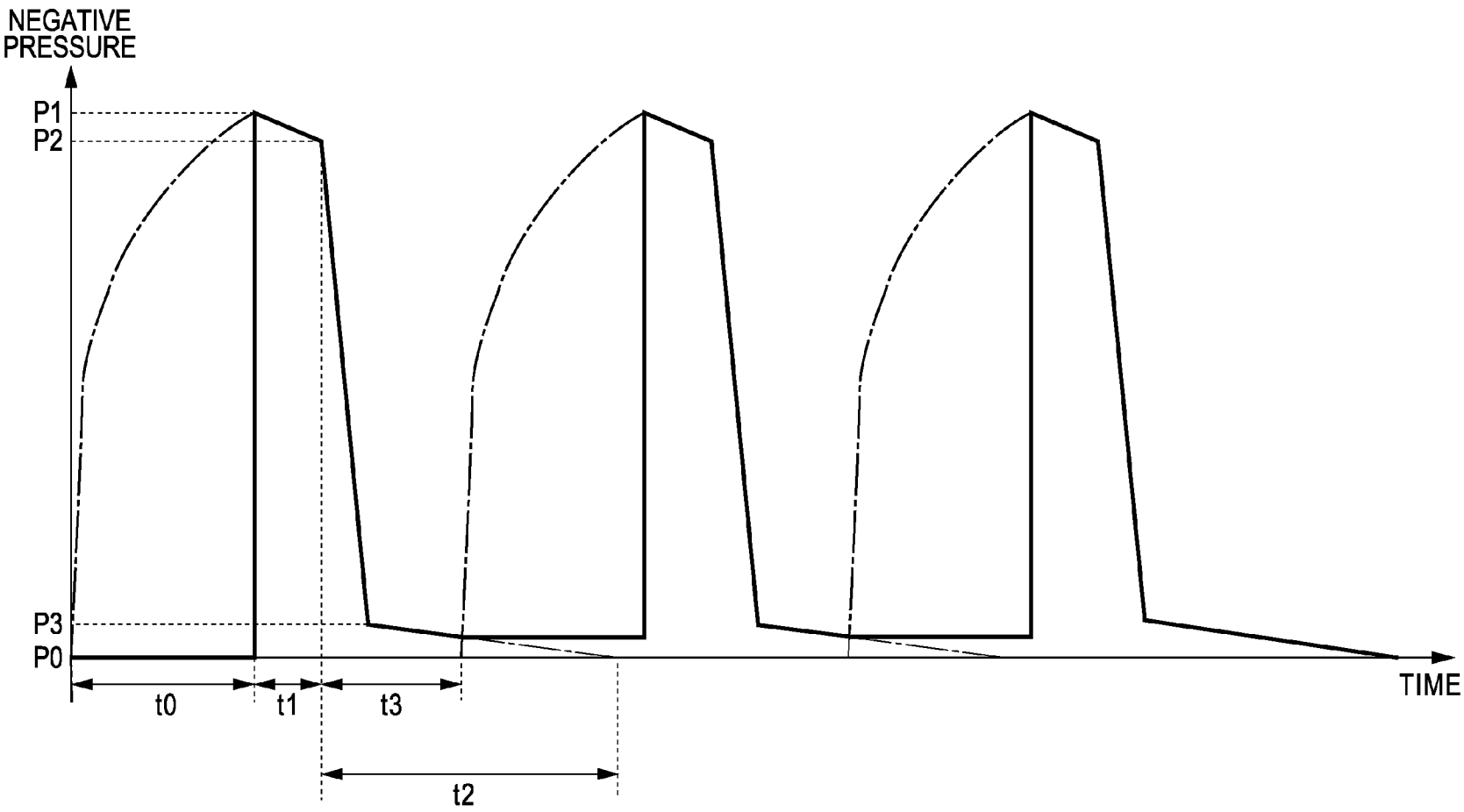
FIG. 4 is a graph showing a change in the pressure state of the closed space area at the time of continuous cleaning in the first embodiment.

Further, in the printer 11, in a case where the nozzle 22 is not restituted in single cleaning, continuous cleaning in which the pressure accumulation process, the discharge process, and the pressure change process in the cleaning are repeatedly carried out in order plural times (in this embodiment, thrice as one example) is performed. At this time, as shown in FIG. 4, after the pressure change process of the first time is started and before the pressure change time t2 elapses, the pressure accumulation process of the second time is started. That is, before the negative pressure state of the closed space area R is subjected to a pressure change from the negative pressure P2 to the atmospheric pressure P0, the first opening and closing valve 55 is made to be in a closed state and also the pump 51 is driven. Then, after the pressure change process of the second time is started and before the pressure change time t2 elapses, the pressure accumulation process of the third time is started. In other words, if a time after the starting of the pressure change process and until the next pressure accumulation process is started is set to be a start time t3, the start time t3 is made to be shorter than the pressure change time t2 (t2>t3). Then, in the pressure change process of the third time, after the pressure state of the closed space area R is subjected to a pressure change until it becomes the atmospheric pressure P0 in the second pressure change process, the continuous cleaning is ended. Therefore, the pressure state of the closed space area R changes up to around the atmospheric pressure in the pressure change processes of the first and second times, but the pressure state of the closed space area R always becomes a negative pressure state during the continuous cleaning.

According to the first embodiment described in detail above, the following effects can be obtained.

(1) In the pressure change process, first, the air flows into the closed space area R in a negative pressure state through the inflow flow path 59, whereby the negative pressure state of the closed space area R is rapidly subjected to a pressure change in a direction of coming to the atmospheric pressure state. Next, the inflow of the air into the closed space area R through the inflow flow path 59 is stopped in a state where negative pressure remains in the closed space area R in which a pressure change is performed in a direction of coming to the atmospheric pressure state in this manner. Thereafter, the remaining negative pressure state of the closed space area R returns to the atmospheric pressure state by a slow pressure change through the discharge flow path 48. Therefore, it is possible to suppress a rapid change of the pressure state of the closed space area R into the atmospheric pressure state, so that it is possible to suppress draw-in of the air in the closed space area R from the nozzle opening 23 of the recording head 19 into the nozzle 22. Therefore, it is possible to suppress breaking of the meniscus Sf of the normal nozzle 22, new nozzle omission, or the like while suppressing the consumption of ink involved in cleaning.

(2) A rapid pressure change from a negative pressure state to an atmospheric pressure state in the first pressure change process is stopped in a state where negative pressure remains in the closed space area R. Then, in the second pressure change process, a negative pressure state by the negative pressure remaining in the closed space area R is subjected to a pressure change in a direction of coming to the atmospheric pressure state, more slowly than that in the first pressure change process. Therefore, it is possible to slowly turn to the atmospheric pressure state, so that it is possible to effectively suppress breaking of the meniscus Sf of the normal nozzle 22, new nozzle omission, or the like.

(3) The negative pressure state of the closed space area R is not subjected to a rapid pressure change until the absolute value of the negative pressure becomes smaller than the absolute value of the draw-in pressure of ink through the intermediary of the nozzle opening 23 of the recording head 19 by the inflow of the air into the closed space area R. In other words, even if the negative pressure state of the closed space area R is subjected to a pressure change in a direction of coming to the atmospheric pressure state by the inflow of the air into the closed space area R, a pressing force from the closed space area R toward the inside of the recording head 19 through the intermediary of the nozzle opening 23 is not generated. Therefore, draw-in of the air from the nozzle opening 23 of the recording head 19 into the nozzle 22 is suppressed. Therefore, it is possible to further suppress breaking of the meniscus Sf of the normal nozzle 22, new nozzle omission, or the like while suppressing the consumption of ink involved in cleaning.

(4) In the pressure change process, since a pressure change is slowly performed until the negative pressure state of the closed space area R naturally turns to the atmospheric pressure state over time without almost performing suction with the use of most all of the time t2 of performing a pressure change of the negative pressure state of the closed space area R in a direction of coming to the atmospheric pressure state, it is possible to arrange the meniscus Sf in the nozzle 22. Therefore, it is possible to further suppress breaking of the meniscus Sf of the normal nozzle 22.

(5) In the continuous cleaning, since suction provided with a pressure difference in a positive pressure direction from around atmospheric pressure where a nozzle recovery effect is high is performed plural times, even in a case where air bubbles which does not make recovery of the nozzle 22 be anticipated in single suction are present in the nozzle, it is possible to effectively remove air bubbles in the nozzle 22 with the small consumption of ink. Therefore, it is possible to further suppress the consumption of ink involved in cleaning.

(6) In the continuous cleaning, in a case where the pressure accumulation process, the discharge process, and the pressure change process are repeatedly performed plural times, before the pressure of the closed space area R turns to the atmospheric pressure P0 in the pressure change process, the next pressure accumulation process is started and a change in the pressure state of the closed space area R is stopped. Therefore, it is possible to always maintain the closed space area R in a negative pressure state. Therefore, it is possible to suppress breaking of the meniscus Sf of the normal nozzle 22, new nozzle omission, or the like.

(7) By allowing the air to flow into the closed space area R which has entered into a negative pressure state by negative pressure generated based on the driving of the pump 51, the negative pressure state of the closed space area R rapidly changes in a direction of coming to the atmospheric pressure state. However, the valve opened to the air 58 is closed just before the negative pressure state of the closed space area R turns to the atmospheric pressure state, whereby a rapid pressure change into the atmospheric pressure state is stopped in a state where negative pressure remains in the closed space area R. Therefore, it is possible to suppress a rapid pressure change until the negative pressure state of the closed space area R turns to the atmospheric pressure state, and it is possible to suppress draw-in of the air in the closed space area R from the nozzle opening 23 of the recording head 19 into the nozzle 22. Therefore, it is possible to suppress breaking of the meniscus Sf of the normal nozzle 22, new nozzle omission, or the like while suppressing the consumption of ink involved in cleaning.

Second Embodiment

Next, a second embodiment of the invention will be described based on FIGS. 5, 6A, and 6B. In addition, comparing the second embodiment with the first embodiment, the configuration of the cleaning apparatus 25 differs in some respects from that in the first embodiment and the other configurations are approximately the same as those in the first embodiment. Therefore, in the following, description is mainly made with respect to the different points from the first embodiment, and with respect to the same configuration, the same symbol is applied thereto and a repeated description is omitted.

Figure 5:
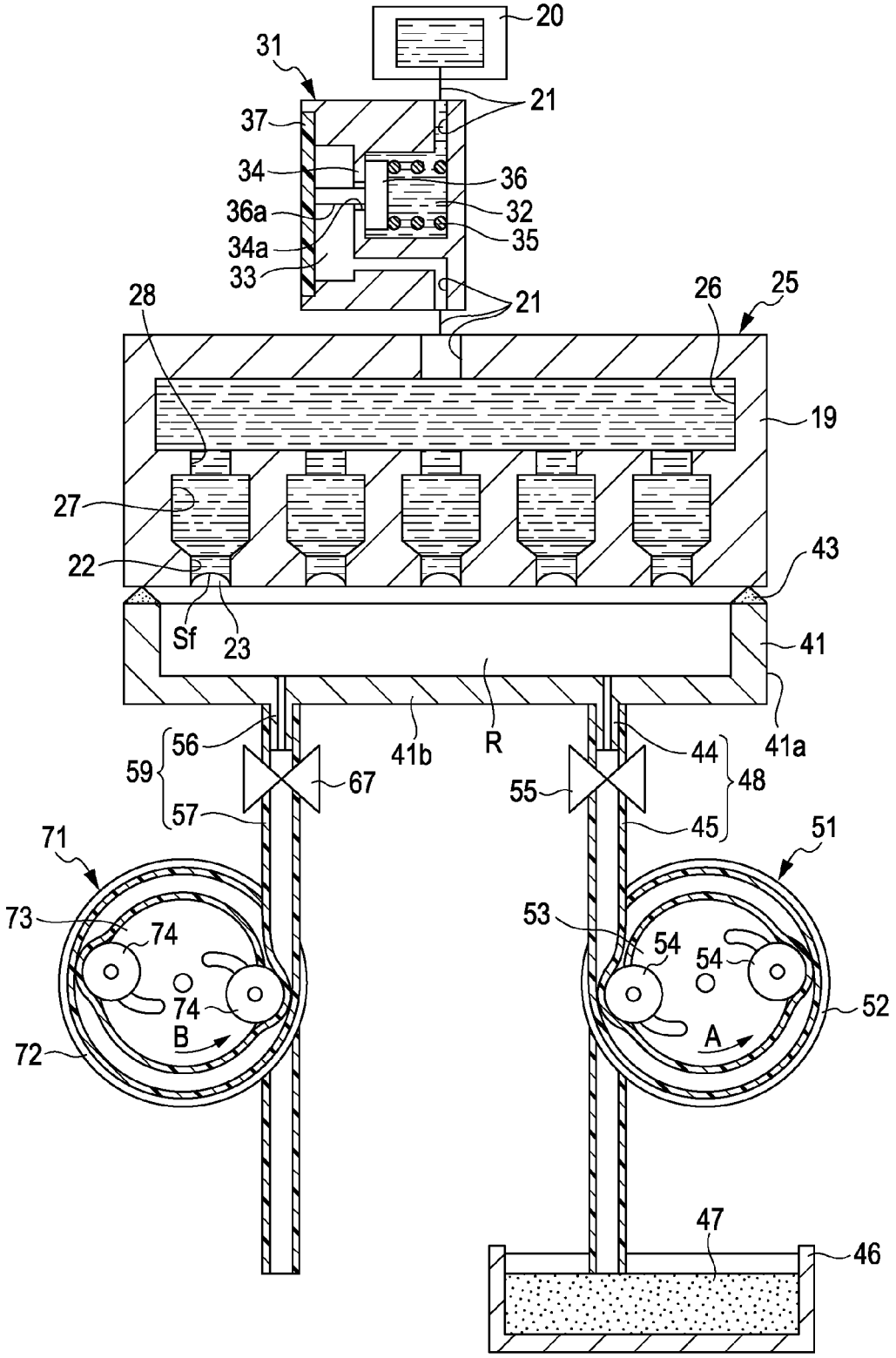
FIG. 5 is a cross-sectional view schematically showing the configurations of an ink supply path, a recording head, and a cleaning apparatus in a second embodiment.

As shown in FIG. 5, in the cleaning apparatus 25 of the second embodiment, the leading end side of the inflow tube 57 constituting a portion of the inflow flow path 59 is opened to the air. Further, in the inflow tube 57, between the leading end side of the inflow tube 57 and the second opening and closing valve 67, a pump 71 is disposed in place of the valve opened to the air 58. The pump 71 is a tube pump having approximately the same configuration as the pump 51 which is disposed between the cap 41 and the waste ink tank 46 in the discharge tube 45. In this embodiment, hereinafter, the pump 51 disposed at the discharge tube 45 is referred to as a first pump 51 and the pump 71 disposed at the inflow tube 57 is referred to as a second pump 71.

The second pump 71 has an approximately cylindrical pump case 72 and also an intermediate portion in the longitudinal direction of the inflow tube 57 is accommodated in the pump case 72 so as to follow an inner peripheral wall of the pump case 72. Further, in the pump case 72, a rotatable rotating body 73 provided at the shaft center of the pump case 72, and a pair of pressing rollers 74 capable of pressing the inflow tube 57 while moving along the inner peripheral surface of the pump case 72 at the time of rotation of the rotating body 73 are accommodated. Then, in the second pump 71, if the rotating body 73 is rotated in the counterclockwise direction indicated by a solid line arrow B in FIG. 5, the pressing rollers 74 rotates while sequentially crushing the intermediate portion of the inflow tube 57 from the leading end side (the upstream side) of the inflow tube 57 to the cap 41 side (the downstream side), whereby air in the inflow tube 57 is sent to the cap 41 side (the downstream side). Further, the second pump 71 is made so as to be able to change the number of rotations of the rotating body 73.

Next, the action of the printer 11 configured as described above will be described based on FIGS. 6A and 6B. In addition, as shown in FIG. 6A, before cleaning is carried out, the differential pressure valve 31, the first opening and closing valve 55, and the second opening and closing valve 67 are in closed states and also the driving of the first pump 51 and the second pump 71 remains stopped.

Now, if cleaning is started, similarly to the case of the first embodiment, the printer 11 moves the carriage 15 up to the home position HP in an area above the cleaning apparatus 25 and stops it at a position immediately above the cap 41. Next, the lifting and lowering mechanism 42 raises the cap 41, thereby bringing the leading end of the seal member 43 of the cap 41 into contact with the nozzle formation surface 24. In addition, as shown in FIGS. 6A and 6B, the pressure state of the closed space area R at this time is under the atmospheric pressure P0.

Figure 6B:
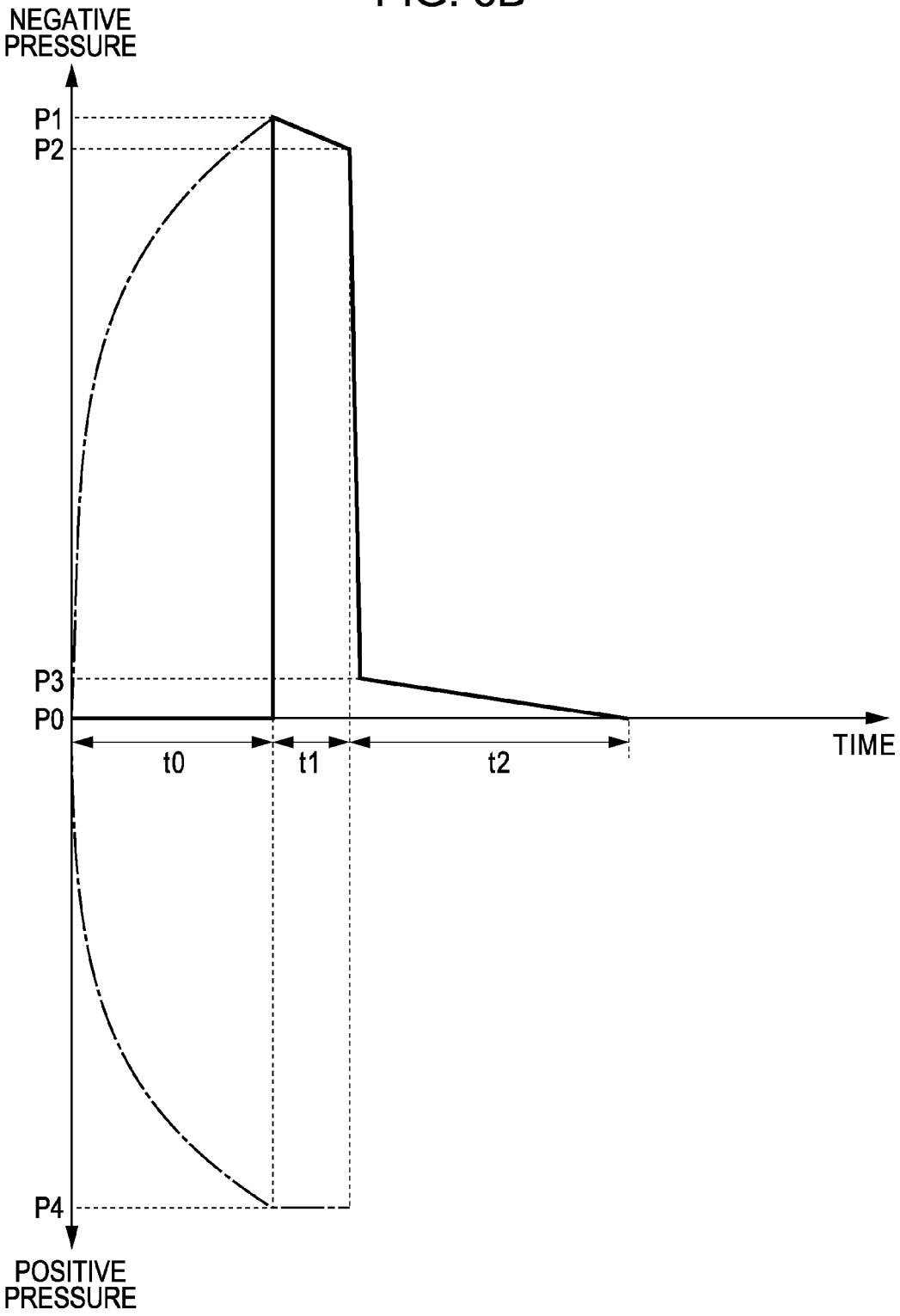
FIG. 6B is a graph showing a change in the pressure state of the closed space area at the time of cleaning in the second embodiment.

Next, as shown in FIG. 6A, as the pressure accumulation process, the first pump 51 and the second pump 71 are driven in a state where the first opening and closing valve 55 and the second opening and closing valve 67 are closed. Then, the inside of the discharge tube 45 further on the upstream side than the first pump 51 is decompressed, so that negative pressure is accumulated in an area between the first pump 51 and the first opening and closing valve 55, which is on the opposite side to the closed space area R with the first opening and closing valve 55 in the discharge flow path 48 as a boundary. Further, the air is compressed in the inside of the inflow tube 57 further on the downstream side than the second pump 71, so that positive pressure is accumulated in an area between the second pump 71 and the second opening and closing valve 67, which is on the opposite side to the closed space area R with the second opening and closing valve 67 in the inflow flow path 59 as a boundary. In addition, in FIG. 6B, the negative pressure which is accumulated in the discharge flow path 48 is shown by a dashed-dotted line and the positive pressure which is accumulated in the inflow flow path 59 is shown by a two-dot chain line.

After the pressure accumulation time t0 has elapsed from the starting of the pressure accumulation process, as the discharge process, the printer 11 stops the driving of the first pump 51 and the second pump 71 and also makes the first opening and closing valve 55 be in an opened state. Then, the closed space area R and the discharge flow path 48 communicate with each other and also the closed space area R is decompressed at once by the negative pressure accumulated in the discharge flow path 48 in the area between the first opening and closing valve 55 and the first pump 51, so that the pressure state of the closed space area R turns from the atmospheric pressure P0 to the negative pressure P1, as shown by a solid line in FIG. 6B. Then, the differential pressure valve 31 enters into an opened state due to the negative pressure state of the closed space area R, so that ink is supplied from the ink cartridge 20 side to the recording head 19 side and also air bubbles, thickened ink, or the like is discharged along with ink from the nozzle openings 23 of the recording head 19 into the cap 41.

After the discharge time t1 which discharges ink from the nozzle openings 23 of the recording head 19 has elapsed from the starting of the discharge process and also the pressure state of the closed space area R has changed from the negative pressure P1 to the negative pressure P2, the printer 11 makes the second opening and closing valve 67 be in an opened state, as the first pressure change process in the pressure change process. Then, the closed space area R and the inflow flow path 59 communicate with each other and also positive pressure P4 accumulated in the inflow flow path 59 is pressurized and supplied at once to the closed space area R, whereby the pressure state of the closed space area R rapidly changes from the negative pressure P2 in a direction of coming to the atmospheric pressure P0.

Further, the air compressed by the second pump 71 and also imparted at once to the closed space area R moves from the inflow pipe 56 toward the discharge pipe 44 parallel to the nozzle formation surface 24 of the recording head 19 at a fast speed in the closed space area R. That is, the air pressurized and supplied from the inflow pipe 56 to the closed space area R moves in a direction intersecting the flow of ink which is discharged from the nozzle openings 23 toward the bottom wall 41*b* that becomes the inner bottom surface of the cap 41, and is then discharged from the discharge pipe 44 to the discharge tube 45. Then, by the flow of the air, the flow of ink which is discharged from the nozzle openings 23 is cut in an area between the nozzle formation surface 24 and the bottom wall 41*b* of the cap 41.

Further, the magnitude of the positive pressure P4 which is imparted to the closed space area R is predetermined so as to become smaller than the magnitude of the negative pressure P1 which is imparted to the closed space area R, and calculated by the following expression.

$$P1V1+P4V2=P3(V1+V2-Vi)$$

Here, P1 is the negative pressure which is imparted to the closed space area R, V1 is the volume of the closed space area R, P4 is the positive pressure which is imparted to the closed space area R, V2 is the volume of the inflow flow path 59 in the area between the second pump 71 and the second opening and closing valve 67, where the compressed air is accumulated, P3 is the negative pressure which remains in the closed space area R, and Vi is the amount of ink which is discharged from the nozzle openings 23 of the recording head 19. Then, in the first pressure change process, pressurization and supply of the air to the closed space area R is stopped in a state where the negative pressure P3 having the magnitude of the pressure absolute value equal to the draw-in pressure of ink through the intermediary of the nozzle opening 23 of the recording head 19 remains in the closed space area R. As a result, as shown in FIG. 6B, a pressure change of the closed space area R in the first pressure change process is stopped after rapid change from the negative pressure P2 up to the negative pressure P3. In this respect, the second pump 71 functions as a pressure adjusting section. Further, at this time, the differential pressure valve 31 enters into a closed state.

After the rapid pressure change of the closed space area R is stopped in the first pressure change process, as the second pressure change process, in a state where inflow of the air into the closed space area R has been stopped, the negative pressure P3 which remains in the closed space area R is changed in a direction of coming to the atmospheric pressure P0. As a result, as shown by a solid line in FIG. 6B, the remaining negative pressure P3 of the closed space area R naturally slowly changes into the atmospheric pressure P0 through the discharge flow path 48. At this time, since in the nozzle 22 of the recording head 19, ink is slightly suctioned, the meniscus Sf of ink in the vicinity of the nozzle opening 23 is arranged.

After the pressure change time t2 has elapsed from the starting of the pressure change process, the lifting and lowering mechanism 42 lowers the cap 41 up to the original position and also the inside of the cap 41 is subjected to idle suction, whereby ink remaining in the cap 41 is discharged into the waste ink tank 46. Then, the cleaning by the cleaning apparatus 25 is ended.

Further, similarly to the case of the first embodiment, in a case where the nozzle 22 is not restituted in single cleaning, the continuous cleaning in which the pressure accumulation process, the discharge process, and the pressure change process in the cleaning are repeatedly carried out in order plural times is performed.

According to the second embodiment described in detail above, in addition to the effects of the above (1) to (6), the following effects can be obtained.

(8) By pressurizing and supplying the air pressure-accumulated in positive pressure in accordance with the driving of the second pump 71 and the transition from the closed state to the opened state of the second opening and closing valve 67, to the closed space area R which has entered into a negative pressure state by the driving of the first pump 51 and the transition from the closed state to the opened state of the first opening and closing valve 55, the negative pressure state of the closed space area R is subjected to a rapid pressure change in a direction of coming to the atmospheric pressure state. Then, the rapid pressure change in this case is stopped in a state where negative pressure remains in the closed space area R, by stopping the driving of the second pump 71 just before the negative pressure state of the closed space area R turns to the atmospheric pressure state. Therefore, it is possible to suppress a rapid pressure change until the negative pressure state of the closed space area R turns to the atmospheric pressure state and it is possible to suppress draw-in of the air of the closed space area R from the nozzle opening 23 of the recording head 19 into the nozzle 22. Therefore, it is possible to suppress breaking of the meniscus Sf of the normal nozzle 22, new nozzle omission, or the like while suppressing the consumption of ink involved in cleaning.

(9) It is possible to impart positive pressure with the magnitude of the pressure absolute value defined by the second pump 71, at once to the closed space area R formed in the cap 41. Then, it is possible to make the negative pressure state of the closed space area R be subjected to a prompt pressure change in a direction of coming to the atmospheric pressure state, by the driving of the second pump 71, and also it is possible to easily stop such a pressure change just before the closed space area R enters into the atmospheric pressure state. Further, the flow of ink which flows from the nozzle openings 23 toward the bottom wall 41*b* of the cap 41 can be cut between the nozzle formation surface 24 of the recording head and the bottom wall 41*b* of the cap 41 by the air compressed by the second pump 71 and also imparted at once to the closed space area R. Therefore, it is possible to suppress attachment of ink to the nozzle formation surface 24 by cleaning.

Third Embodiment

Next, a third embodiment of the invention will be described based on FIGS. 7, 8A, and 8B. In addition, comparing the third embodiment with the first and second embodiments, the configuration of the cleaning apparatus 25 differs in some respects from those in the first and second embodiments and the other configurations are approximately the same as those in the first and second embodiments. Therefore, in the following, description is mainly made with respect to the different points from the first and second embodiments, and with respect to the same configuration, the same symbol is applied thereto and a repeated description is omitted.

Figure 7:
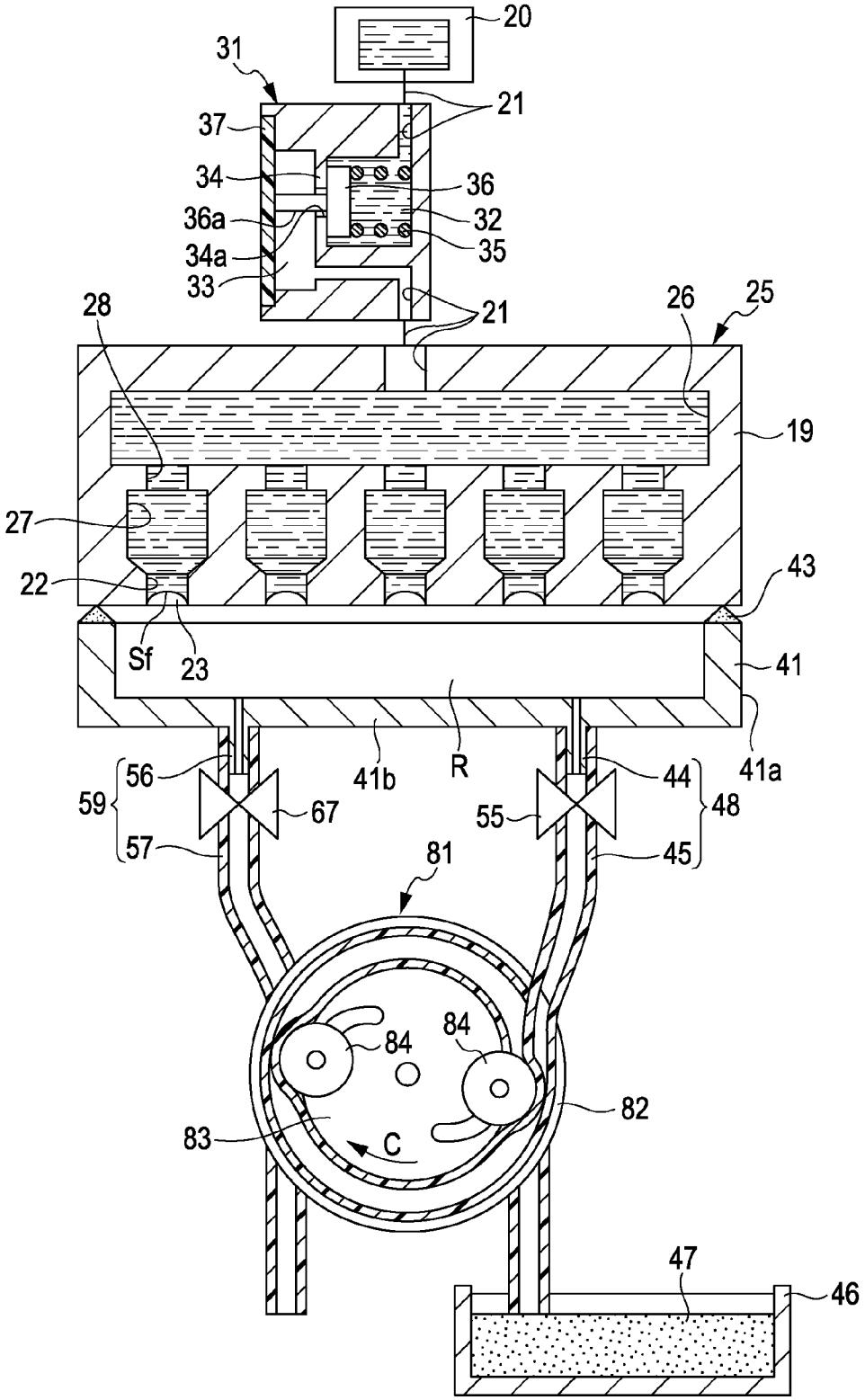
FIG. 7 is a cross-sectional view schematically showing the configurations of an ink supply path, a recording head, and a cleaning apparatus in a third embodiment.

As shown in FIG. 7, in the cleaning apparatus 25 of the third embodiment, a pump 81 which is a single tube pump is disposed midway on the discharge flow path 48 and the inflow flow path 59.

That is, the pump 81 has an approximately cylindrical pump case 82 and also an intermediate portion in the longitudinal direction of the discharge tube 45 is accommodated in the pump case along the inner wall surface of the pump case 82. The discharge tube 45 accommodated in the pump case 82 is disposed so as to go into a 360-degree roll in the clockwise direction in FIG. 7 from the cap 41 side toward the waste ink tank 46 side. Further, in the pump case 82, an intermediate portion in the longitudinal direction of the inflow tube 57 is accommodated along the inner wall surface of the pump case 82 so as to overlap the discharge tube 45 in the left-and-right direction. The inflow tube 57 accommodated in the pump case 82 is disposed so as to go into a 360-degree roll in the counterclockwise direction in FIG. 7 from the cap 41 side toward the leading end side which becomes the aerial space side.

Further, in the pump case 82, a rotatable rotating body 83 provided at the shaft center of the pump case 82, and pressing rollers 84 as a pair of pressing members capable of simultaneously pressing the discharge tube 45 and the inflow tube 57 while moving along the inner peripheral surface of the pump case 82 at the time of rotation of the rotating body 83 are accommodated. Then, if the rotating body 83 is rotated in the clockwise direction indicated by a solid line arrow C in FIG. 7, the pressing rollers 84 rotate while sequentially crushing the intermediate portions of the discharge tube 45 and the inflow tube 57, whereby the inside of the discharge tube 45 further on the cap side than the pump 81 is decompressed and also the inside of the inflow tube 57 further on the cap side than the pump 81 is pressurized. Further, the diameter of the inflow tube 57 is made to be smaller than the diameter of the discharge tube 45.

Next, the action of the printer 11 configured as described above will be described based on FIGS. 8A and 8B. In addition, as shown in FIG. 8A, before cleaning is carried out, the differential pressure valve 31, the first opening and closing valve 55, and the second opening and closing valve 67 are in closed states and also the driving of the pump 81 remains stopped.

Now, if cleaning is started, similarly to the cases of the first and second embodiments, the printer 11 moves the carriage 15 up to the home position HP in an area above the cleaning apparatus 25 and stops it at a position immediately above the cap 41. Next, the lifting and lowering mechanism 42 raises the cap 41, thereby bringing the leading end of the seal member 43 of the cap 41 into contact with the nozzle formation surface 24. In addition, as shown in FIGS. 8A and 8B, the pressure state of the closed space area R at this time is under the atmospheric pressure P0.

Figure 8B:
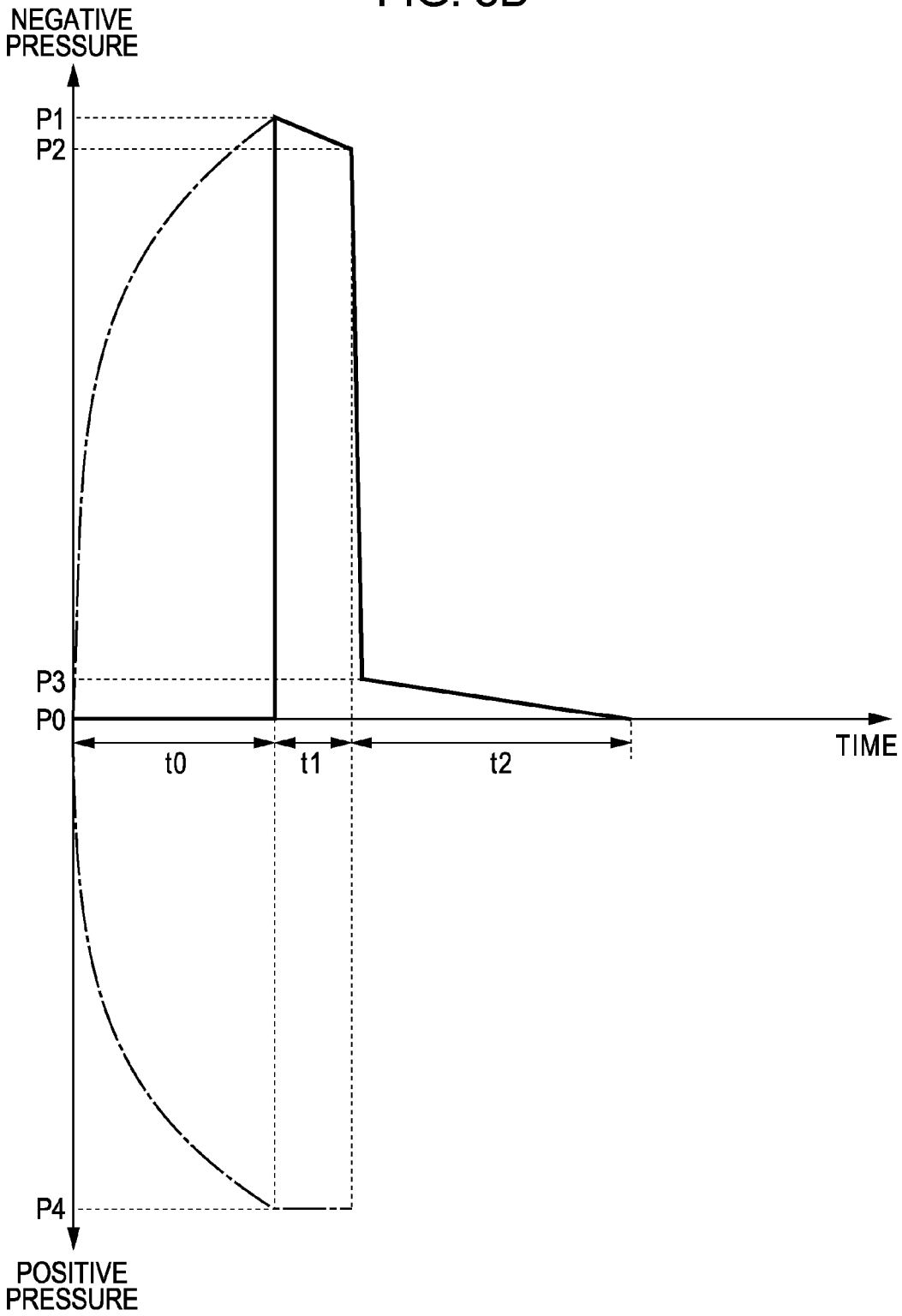
FIG. 8B is a graph showing a change in the pressure state of the closed space area at the time of cleaning in the third embodiment.

Next, as shown in FIG. 8A, as the pressure accumulation process, the pump 81 are driven in a state where the first opening and closing valve 55 and the second opening and closing valve 67 are closed. Then, negative pressure is accumulated in the discharge flow path 48 in the area between the pump 81 and the first opening and closing valve 55 in the discharge flow path 48 and also positive pressure is accumulated in the inflow flow path 59 in the area between the pump 81 and the second opening and closing valve 67 in the inflow flow path 59. In addition, in FIG. 8B, the negative pressure which is accumulated in the discharge flow path 48 is shown by a dashed-dotted line and the positive pressure which is accumulated in the inflow flow path 59 is shown by a two-dot chain line. Here, since the diameter of the inflow tube 57 is made to be smaller than the diameter of the discharge tube 45, the magnitude of the positive pressure which is accumulated in the inflow flow path 59 becomes smaller than the magnitude of the negative pressure which is accumulated in the discharge flow path 48.

After the pressure accumulation time t0 has elapsed from the starting of the pressure accumulation process, as the discharge process, the printer 11 stops the driving of the pump 81 and also makes the first opening and closing valve 55 be in an opened state. Then, as shown in FIG. 8B, the closed space area R is decompressed at once, so that the pressure state of the closed space area R turns from the atmospheric pressure P0 to the negative pressure P1. Then, the differential pressure valve 31 enters into an opened state due to the negative pressure state of the closed space area R and also air bubbles, thickened ink, or the like is discharged along with ink from the nozzle openings 23 of the recording head 19 into the cap 41.

After the discharge time t1 has elapsed from the starting of the discharge process and also the pressure state of the closed space area R has changed from the negative pressure P1 to the negative pressure P2, the printer 11 makes the second opening and closing valve 67 be in an opened state, as the first pressure change process in the pressure change process. Then, the positive pressure P4 accumulated in the inflow flow path 59 is pressurized and supplied at once to the closed space area R, whereby the pressure state of the closed space area R rapidly changes from the negative pressure P2 in a direction of coming to the atmospheric pressure P0. Further, the air imparted at once to the closed space area R moves from the inflow pipe 56 toward the discharge pipe 44 parallel to the nozzle formation surface 24 of the recording head 19 at a fast speed in the closed space area R, thereby cutting the flow of ink which is discharged from the nozzle openings 23, in the area between the nozzle formation surface 24 and the bottom wall 41*b* of the cap 41.

Further, since the magnitude of the positive pressure P4 which is imparted to the closed space area R is smaller in pressure absolute value than the magnitude of the negative pressure P1 which is imparted to the closed space area R, in the first pressure change process, pressurization and supply of the air to the closed space area R is stopped in a state where negative pressure remains in the closed space area R. At this time, the magnitude of the positive pressure which is imparted to the closed space area R is predetermined using the same expression as that in the case of the second embodiment such that the negative pressure which remains in the closed space area R becomes the negative pressure P3 having the magnitude of the pressure absolute value equal to the draw-in pressure of ink through the intermediary of the nozzle opening 23 in the recording head 19. As a result, as shown in FIG. 8B, a pressure change of the closed space area R in the first pressure change process is stopped after rapid change from the negative pressure P2 up to the negative pressure P3. At this time, the differential pressure valve 31 enters into a closed state.

After the rapid pressure change of the closed space area R is stopped in the first pressure change process, as the second pressure change process, in a state where inflow of the air into the closed space area R has been stopped, the negative pressure P3 which remains in the closed space area R is changed in a direction of coming to the atmospheric pressure P0. As a result, as shown in FIG. 8B, the remaining negative pressure P3 of the closed space area R naturally slowly changes into the atmospheric pressure P0 through the discharge flow path 48.

At this time, since in the nozzle 22 of the recording head 19, ink is slightly suctioned, the meniscus Sf of ink in the vicinity of the nozzle opening 23 is arranged.

After the pressure change time t2 has elapsed from the starting of the pressure change process, the lifting and lowering mechanism 42 lowers the cap 41 up to the original position and also the inside of the cap 41 is subjected to idle suction, whereby ink remaining in the cap 41 is discharged into the waste ink tank 46. Then, the cleaning by the cleaning apparatus 25 is ended.

Further, similarly to the cases of the first and second embodiments, in a case where the nozzle 22 is not restituted in single cleaning, the continuous cleaning in which the pressure accumulation process, the discharge process, and the pressure change process in the cleaning are repeatedly carried out in order plural times is performed.

According to the third embodiment described in detail above, in addition to the effects of the above (1) to (6), (8), and (9), the following effect can be obtained.

(10) By making the flow path cross-sectional areas of the discharge flow path 48 and the inflow flow path 59 different from each other, it is possible to impart negative pressure and positive pressure in which the magnitudes of the pressure absolute values are different from each other, to the closed space area R by the single pump 81. Therefore, it is possible to simply configure the cleaning apparatus 25 in which it is possible to suppress breaking of a normal meniscus, new nozzle omission, or the like while suppressing the consumption of ink involved in cleaning, without increasing the number of components.

Fourth Embodiment

Next, a fourth embodiment of the invention will be described based on FIGS. 9A and 9B. In addition, comparing the fourth embodiment with the first to third embodiments, the configuration of the cleaning apparatus 25 is the same as that in the second embodiment. Therefore, in the following, different actions from those in the first to third embodiments are described based on FIGS. 9A and 9B. In addition, as shown in FIG. 9A, before cleaning is carried out, the differential pressure valve 31, the first opening and closing valve 55, and the second opening and closing valve 67 are in a closed state and also the driving of the first pump 51 and the second pump 71 remains stopped.

Now, if cleaning is started, similarly to the cases of the first to third embodiments, the printer 11 moves the carriage 15 up to the home position HP in an area above the cleaning apparatus 25 and stops it at a position immediately above the cap 41. Next, the lifting and lowering mechanism 42 raises the cap 41, thereby bringing the leading end of the seal member 43 of the cap 41 into contact with the nozzle formation surface 24. In addition, as shown in FIGS. 9A and 9B, the pressure state of the closed space area R at this time is under the atmospheric pressure P0.

Figure 9B:
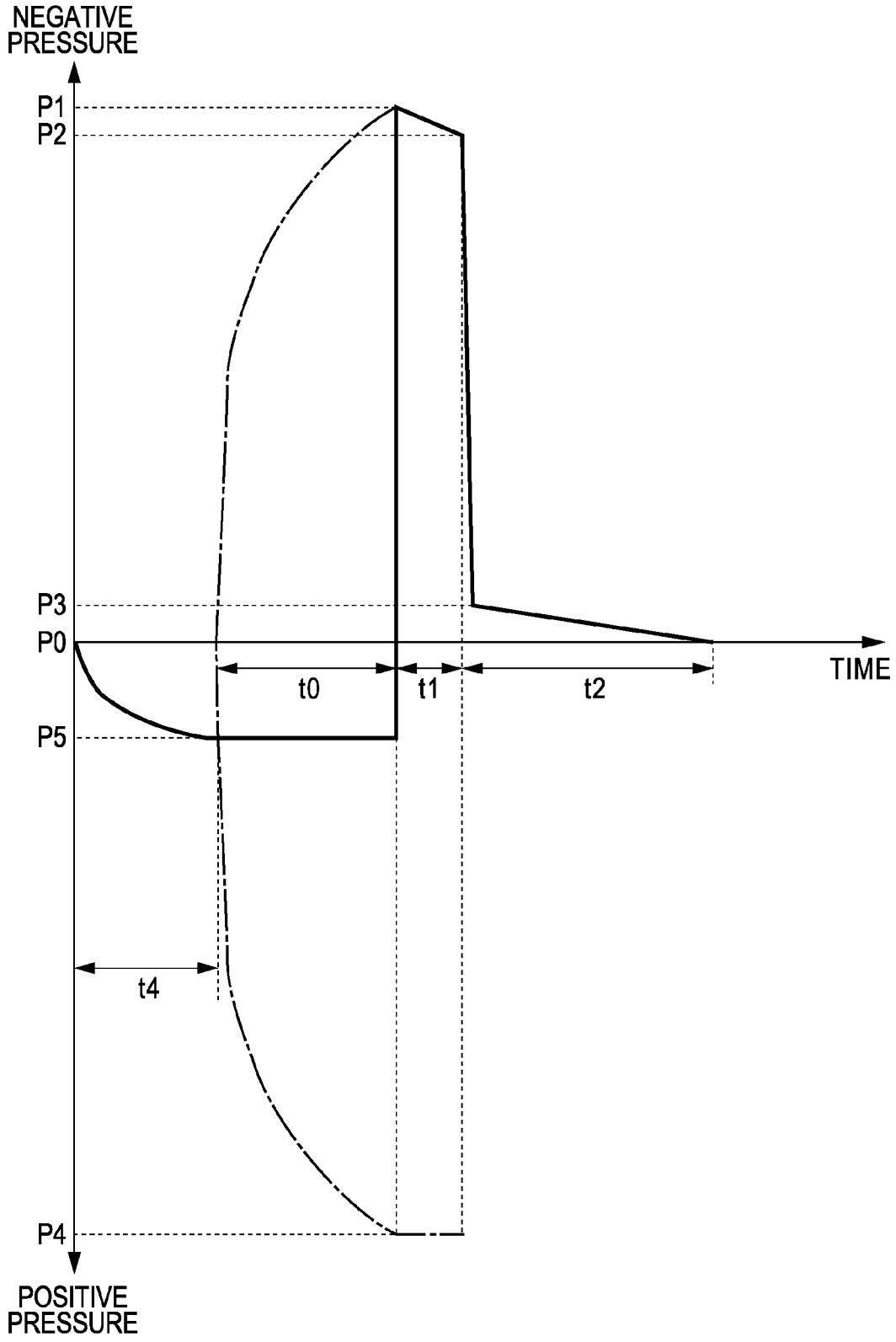
FIG. 9B is a graph showing a change in the pressure state of the closed space area at the time of cleaning in the fourth embodiment.

Next, as shown in FIG. 9A, as a pressurization process, the printer 11 makes the second opening and closing valve 67 be in an opened state and also drives the second pump 71. Then, as shown in FIG. 9B, the air is imparted to the closed space area R by the driving of the second pump 71, whereby the pressure state of the closed space area R gradually rises in pressure in a positive pressure direction from the atmospheric pressure P0. Here, in a case where the magnitude of the positive pressure of the closed space area R is larger than clip pressure on the nozzle opening 23 of the boundary of the meniscus Sf in the nozzle 22, the meniscus Sf is destroyed, so that ink is drawn into the nozzle 22. In addition, the "clip pressure" means a force in which a state is created where the boundary of the meniscus Sf is caught in the nozzle opening 23, so that the position of the meniscus Sf does not move. Therefore, positive pressure P5 which is imparted to the closed space area R in the pressurization process becomes equal to or less than the clip pressure of the meniscus Sf.

After the pressurization time t4 has elapsed from the starting of the pressurization process and also the pressure state of the closed space area R has changed from the atmospheric pressure P0 to the positive pressure P5, as the pressure accumulation process, the second opening and closing valve 67 is made to be in a closed state and also the first pump 51 and the second pump 71 are driven. Then, the inside of the discharge tube 45 further on the upstream side than the first pump 51 is decompressed, so that negative pressure is accumulated in the discharge flow path 48 in the area between the first pump 51 and the first opening and closing valve 55. Further, the air is compressed in the inside of the inflow tube 57 further on the downstream side than the second pump 71, so that positive pressure is accumulated in the inflow flow path 59 in the area between the second pump 71 and the second opening and closing valve 67. In addition, in FIG. 9B, the negative pressure which is accumulated in the discharge flow path 48 is shown by a dashed-dotted line and the positive pressure which is accumulated in the inflow flow path 59 is shown by a two-dot chain line.

After the pressure accumulation time t0 has elapsed from the starting of the pressure accumulation process, as the discharge process, the printer 11 stops the driving of the first pump 51 and the second pump 71 and also makes the first opening and closing valve 55 be in an opened state. Then, as shown in FIG. 9B, the closed space area R is decompressed at once, so that the pressure state of the closed space area R turns from the positive pressure P5 to the negative pressure P1. Then, the differential pressure valve 31 enters into an opened state due to the negative pressure state of the closed space area R and also air bubbles, thickened ink, or the like is discharged along with ink from the nozzle openings 23 of the recording head 19 into the cap 41.

Here, comparing a case where the pressure state of the closed space area R changes from the atmospheric pressure P0 into the negative pressure P1 with a case where it changes from the positive pressure P5 in which pressure is larger in a positive pressure direction than the atmospheric pressure P0 into the negative pressure P1, in the case of the change from the positive pressure P5 into the negative pressure P1, a pressure difference of the change becomes larger than that in the case of the change from the atmospheric pressure P0 into the negative pressure P1. Therefore, the flow rate of ink which is discharged from the nozzle opening 23 becomes faster than the flow rate of ink in the case of the change from the atmospheric pressure P0 into the negative pressure P1, so that air bubbles, thickened ink, or the like which is present in the nozzle 22 is easily discharged.

After the discharge time t1 has elapsed from the starting of the discharge process and also the pressure state of the closed space area R has changed from the negative pressure P1 to the negative pressure P2, as the first pressure change process, the printer 11 makes the second opening and closing valve 67 be in an opened state. Then, the positive pressure accumulated in the inflow flow path 59 is pressurized and supplied at once to the closed space area R, whereby the pressure state of the closed space area R rapidly changes from the negative pressure P2 in a direction of coming to the atmospheric pressure P0. Further, the air imparted at once to the closed space area R moves from the inflow pipe 56 toward the discharge pipe 44 parallel to the nozzle formation surface 24 of the recording head 19 at a fast speed in the closed space area R, thereby cutting the flow of ink which is discharged from the nozzle openings 23, in the area between the nozzle formation surface 24 and the bottom wall 41*b* of the cap 41.

Further, the magnitude of the positive pressure P4 which is imparted to the closed space area R is predetermined using the same expression as the case of the second and third embodiments such that the pressure absolute value becomes smaller than the magnitude of the negative pressure P1 which is imparted to the closed space area R. Then, in the first pressure change process, pressurization and supply of the air to the closed space area R is stopped in a state where the negative pressure P3 having the magnitude of the pressure absolute value equal to the draw-in pressure of ink through the intermediary of the nozzle opening 23 in the recording head 19 remains in the closed space area R. As a result, as shown in FIG. 9B, a pressure change of the closed space area R in the first pressure change process is stopped after rapid change from the negative pressure P2 up to the negative pressure P3. At this time, the differential pressure valve 31 enters into a closed state.

After the rapid pressure change of the closed space area R is stopped in the first pressure change process, as the second pressure change process, in a state where inflow of the air into the closed space area R has been stopped, the negative pressure P3 which remains in the closed space area R is slowly changed in a direction of coming to the atmospheric pressure P0. As a result, as shown in FIG. 9B, the remaining negative pressure P3 of the closed space area R naturally slowly changes into the atmospheric pressure P0 through the discharge flow path 48. At this time, since in the nozzle 22 of the recording head 19, ink is slightly suctioned, the meniscus Sf of ink in the vicinity of the nozzle opening 23 is arranged.

After the pressure change time t2 has elapsed from the starting of the pressure change process, the lifting and lowering mechanism 42 lowers the cap 41 up to the original position and also the inside of the cap 41 is subjected to idle suction, whereby ink remaining in the cap 41 is discharged into the waste ink tank 46. Then, the cleaning by the cleaning apparatus 25 is ended.

According to the fourth embodiment described in detail above, in addition to the effects of the above (1) to (6), (8), and (9), the following effect can be obtained.

(11) By imparting positive pressure to the closed space area R before the pressure state of the closed space area R is made to be in a negative pressure state, thereby making the pressure state of the closed space area R a positive pressure state having larger pressure than the atmospheric pressure P0, it is possible to make a pressure difference at the time of pressure change into a negative pressure state large compared to a case where positive pressure is not imparted. Therefore, it is possible to increase the flow rate of ink which is discharged from the nozzle opening 23, so that it is possible to easily discharge air bubbles or thickened ink which is present in the nozzle 22. Therefore, it is possible to increase the reversion rate of the nozzle 22.

In addition, the above embodiments may also be changed as follows.

In the first embodiment, the pressure adjusting valve is not limited to the valve opened to the air 58 and may also be, for example, an electromagnetic valve or the like. However, in this case, it is preferable that the valve be provided with a pressure gauge which detects the pressure state of the closed space area R and controlled so as to opened and closed depending on the pressure state of the closed space area R. Further, in a case where a pressure gauge is provided and also the second opening and closing valve 67 is made to be an electromagnetic valve, the second opening and closing valve 67 may double as a pressure adjusting valve.

In the second embodiment, the pressure adjusting section is not limited to the second pump 71 which is a tube pump and may also be, for example, a piston pump, a pump using an electromagnetic clutch, or the like.

In the third embodiment, the diameter of the inflow tube 57 is not limited to a diameter smaller than the diameter of the discharge tube 45 and may also be equal to or greater than the diameter of the discharge tube 45. However, in such a case, it is preferable that the discharge tube 45 and the inflow tube 57 be tubes which are respectively pressed by different pressing rollers provided in the pump 81, and the pressing force of the pressing roller which presses the inflow tube 57 be weaker than the pressing force of the pressing roller which presses the discharge tube 45. Then, in such a case, by changing the efficiency of the pump 81 on the discharge flow path 48 and the inflow flow path 59, it is possible to impart negative pressure and positive pressure in which the magnitudes of the pressure absolute value are different from each other, to the closed space area R by the single pump 81. Therefore, it is possible to simply configure the cleaning apparatus 25 in which it is possible to suppress breaking of the normal meniscus Sf, new nozzle omission, or the like while suppressing the consumption of ink involved in cleaning.

In the fourth embodiment, the positive pressure P5 which is imparted to the closed space area R in the pressurization process is not limited to a case where the pressure absolute value thereof is equal to or less than the pressure absolute value of the clip pressure of the meniscus Sf in the nozzle 22, and may also have the pressure absolute value larger than the clip pressure of the meniscus Sf. In this case, by drawing the air into the nozzle 22, the meniscus Sf is temporarily broken. However, thereafter, since ink is finally slightly suctioned in the pressure change process after ink discharge in the discharge process, the meniscus Sf of ink in the vicinity of the nozzle opening 23 is arranged.

In the second to fourth embodiments, the positive pressure P4 imparted by the second pump 71 or the pump 81 may not be predetermined. However, in this case, it is preferable that the second opening and closing valve 67 be made to be an electromagnetic valve and also a pressure gauge which detects the pressure of the closed space area R be provided, so that control is performed so as to open and close the second opening and closing valve 67 depending on the pressure state of the closed space area R.

In the first to third embodiments, in the case of carrying out the continuous cleaning, the start time t3 until the next pressure accumulation process is started after the pressure change process is not limited to a case where it is shorter than the pressure change time t2, and may also be equal to or more than the pressure change time t2. Further, the continuous cleaning may not be carried out.

In the first to fourth embodiments, the pressure change time t2 is not limited to a case where it is longer than the discharge time t1, and may also be equal to or less than the discharge time t1.

In the first to fourth embodiments, the magnitude of the negative pressure P3 which remains in the closed space area R in the first pressure change process is not limited to a case where the magnitude of the pressure absolute value is equal to the draw-in pressure of ink through the intermediary of the nozzle opening 23 in the recording head 19 and the pressure absolute value may also be larger than the draw-in pressure of ink.

In the first to fourth embodiments, a suction section is not limited to the first pump 51 which is a tube pump, and may also be, for example, a piston pump, a pump using an electromagnetic clutch, or the like.

In the first to fourth embodiments, the recording medium is not limited to the recording paper P and may also be, for example, continuous film, long cloth, or the like.

In the first to fourth embodiments, the printer 11 may also be realized as a full-line type line head printer which is provided with a long liquid ejecting head, or a lateral type printer.

Although in the above embodiments, the liquid ejecting apparatus has been embodied in the ink jet type printer 11, a liquid ejecting apparatus which ejects or discharges liquid other than ink may also be adopted. The invention can be applied to various liquid ejecting apparatuses which are each provided with a liquid ejecting head or the like that discharges a minutely small quantity of liquid droplets. In addition, a liquid droplet means a liquid in a state of being discharged from the above liquid ejecting apparatus and is also set to include droplets of a granular shape or a tear shape, or droplets tailing into a line. Further, it is acceptable if the liquid as mentioned herein is a material that a liquid ejecting apparatus can eject. For example, it is acceptable if the liquid is a substance in a state when it is in a liquid phase, and the liquid includes not only bodies in a liquid state with high or low viscosity and in a flow state such as sol, gel water, other inorganic solvents, an organic solvent, a solution, a liquid resin, or a liquid metal (molten metal), and liquid as one state of substance, but also a material in which particles of a functional material composed of a solid material such as pigment or metal particles are dissolved, dispersed, or mixed in a solvent, or the like. Further, ink as described in the above embodiments, liquid crystal, or the like can be given as representative examples of the liquid. Here, ink is set to include general water-based ink and oil-based ink, and various liquid compositions such as gel ink or hot-melt ink. As a specific example of the liquid ejecting apparatus, a liquid ejecting apparatus which ejects liquid which includes, in a dispersed or dissolved form, a material such as an electrode material or a color material, which is used for the manufacture or the like of, for example, a liquid crystal display, an EL (electroluminescence) display, a surface-emitting display, or a color filter, a liquid ejecting apparatus which ejects biological organic matter which is used for the manufacturing of a biochip, a liquid ejecting apparatus which is used as a precision pipette and ejects liquid which becomes a sample, a cloth printing apparatus, a micro-dispenser, or the like is also acceptable. Further, a liquid ejecting apparatus which ejects lubricant to a precision machine such as a clock or a camera by a pin point, a liquid ejecting apparatus which ejects transparent resin solution such as ultraviolet curing resin onto a substrate in order to form a hemispherical micro-lens (an optical lens) or the like which is used in an optical communication element or the like, or a liquid ejecting apparatus which ejects etching solution such as acid or alkali in order to etch a substrate or the like may also be adopted. Thus, the invention can be applied to any type of liquid ejecting apparatus among these apparatuses.

What is claimed is:

1. A cleaning method of performing cleaning in which suction is performed on a closed space area enclosed and formed between a liquid ejecting head and a bottomed box-shaped cap by bringing the cap into contact with the liquid ejecting head so as to surround nozzle openings which eject liquid in the liquid ejecting head, by a suction section, thereby discharging the liquid from the nozzle openings, the method comprising:

a pressure accumulation process accumulating negative pressure in a flow path which is on the opposite side to the closed space area in a first flow path which communicates with the closed space area and which suction power by the suction section reaches, with a first opening and closing valve provided midway on the first flow path so as to be able to open and close the first flow path, as a boundary, by making the first opening and closing valve be in a closed state and also driving the suction section;

a discharge process discharging the liquid from the nozzle openings by making the first opening and closing valve be in an opened state, thereby making the closed space area be in a negative pressure state, after the pressure accumulation; and a pressure change process performing a pressure change in which the negative pressure state of the closed space area is subjected to a pressure change in a direction of coming to an atmospheric pressure state, after the discharging process, the pressure change process including a first pressure change process and a second pressure change process, the first pressure change process performing the pressure change by allowing the air to flow into the closed space area by making a second flow path which makes the closed space area and an aerial space communicate with each other be in an opened state and stopping the inflow of the air into the closed space area through the second flow path in a state where the negative pressure remains in the closed space area, and the second pressure change process performing the pressure change in a state where the inflow of the air into the closed space area through the second flow path remains stopped after the first pressure change process;

wherein the first pressure change process that performs the pressure change by allowing the air to flow into the closed space area by making a second opening and closing valve be in an opened state, the opening and closing valve being provided midway on the second flow path, and in the second pressure change process the inflow of the air into the closed space area through the second flow path and flow of liquid towards the liquid ejecting head is stopped in the state where the negative pressure remains in the closed space area, the flow of liquid towards the liquid ejecting head being stopped as an another open and close valve upstream of the liquid ejecting head enters a closed state at the same time as the second opening and closing valve stops the inflow of air into the closed state.

2. A cleaning method of performing cleaning in which suction is performed on a closed space area enclosed and formed between a liquid ejecting head and a bottomed box-shaped cap by bringing the cap into contact with the liquid ejecting head so as to surround nozzle openings which eject liquid in the liquid ejecting head, by a suction section, thereby discharging the liquid from the nozzle openings, the method comprising:

a pressure accumulation process accumulating negative pressure in a flow path which is on the opposite side to the closed space area in a first flow path which communicates with the closed space area and which suction power by the suction section reaches, with a first opening and closing valve provided midway on the first flow path so as to be able to open and close the first flow path, as a boundary, by making the first opening and closing valve be in a closed state and also driving the suction section;

a discharge process discharging the liquid from the nozzle openings by making the first opening and closing valve be in an opened state, thereby making the closed space area be in a negative pressure state, after the pressure accumulation; and a pressure change process performing a pressure change in which the negative pressure state of the closed space area is subjected to a pressure change in a direction of coming to an atmospheric pressure state, after the discharging process, the pressure change process including a first pressure change process and a second pressure change process, the first pressure change process performing the pressure change by allowing the air to flow into the closed space area by making a second flow path which makes the closed space area and an aerial space communicate with each other be in an opened state and stopping the inflow of the air into the closed space area through the second flow path in a state where the negative pressure remains in the closed space area, and the second pressure change process performing the pressure change in a state where the inflow of the air into the closed space area through the second flow path remains stopped after the first pressure change process.

3. The cleaning method according to claim 2, wherein the second pressure change process performs the pressure change more slowly than that at the time of the first pressure change process.

4. The cleaning method according to claim 2, wherein a magnitude of the absolute value of the negative pressure remaining in the closed space area in the pressure change process is equal to a magnitude of the absolute value of draw-in pressure of the liquid through the intermediary of the nozzle opening which is present in the liquid ejecting head.

5. The cleaning method according to claim 2, wherein the first pressure change process performs the pressure change by supplying a pressurized air to the closed space via the second flow path be in an opened state.

6. The cleaning method according to claim 2, further comprising: a pressurization process of making the second opening and closing valve be in an opened state, thereby pressurizing and supplying the air to the closed space area, before the discharge process.

7. The cleaning method according to claim 2, wherein the second flow path is made in the opened state so that pressure change in the closed space area in the discharge process is smaller than pressure change in the pressure change process.

8. The cleaning method according to claim 2, wherein the inflow of the air into the closed space area through the second flow path is stopped in the state where the negative pressure remains in the closed space area by making the second flow path be in a closed state.

9. The cleaning method according to claim 2, wherein the first pressure change process that performs the pressure change by allowing the air to flow into the closed space area by making a second opening and closing valve be in an opened state, the opening and closing valve being provided midway on the second flow path, and in the second pressure change process the inflow of the air into the closed space area through the second flow path and flow of liquid towards the liquid ejecting head is stopped in the state where the negative pressure remains in the closed space area, the flow of liquid towards the liquid ejecting head being stopped as an another open and close valve upstream of the liquid ejecting head enters a closed state at the same time as the second opening and closing valve stops the inflow of air into the closed state.

10. The cleaning method according to claim 2, wherein pressure change in the closed space area in the discharge process is smaller than pressure change in the first pressure change process.

11. The cleaning method according to claim 2, wherein when a time to perform the discharge process is set to be t1 and a time to perform the pressure change process until it turns from the negative pressure state to the atmospheric pressure state is set to be t2, the relationship of t1<t2 is established.

12. The cleaning method according to claim 11, wherein the pressure accumulation process, the discharge process, and the pressure change process are repeatedly carried out in order plural times.

13. The cleaning method according to claim 12, wherein when a time until the next pressure accumulation process is started after the starting of the pressure change process is set to be t3, the relationship of t2>t3 is established.

* * * * *